US011964840B2

(12) United States Patent
Maeda

(10) Patent No.: US 11,964,840 B2
(45) Date of Patent: Apr. 23, 2024

(54) FEEDING APPARATUS FOR FEEDING SHEET-SHAPED MEDIUM, AND USING APPARATUS FOR USING SHEET-SHAPED MEDIUM

(71) Applicant: FUJIFILM Business Innovation Corp., Tokyo (JP)

(72) Inventor: Shoichi Maeda, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 215 days.

(21) Appl. No.: 17/466,020

(22) Filed: Sep. 3, 2021

(65) Prior Publication Data

US 2022/0371839 A1 Nov. 24, 2022

(30) Foreign Application Priority Data

May 24, 2021 (JP) ..... 2021-086863

(51) Int. Cl.
*B65H 3/12* (2006.01)

(52) U.S. Cl.
CPC ..... *B65H 3/128* (2013.01); *B65H 2404/6551* (2013.01); *B65H 2404/6552* (2013.01); *B65H 2406/323* (2013.01)

(58) Field of Classification Search
CPC ..... B65H 3/128; B65H 2404/6551; B65H 2404/6552; B65H 2406/323
See application file for complete search history.

(56) References Cited

U.S. PATENT DOCUMENTS 5,150,892 A * 9/1992 Shimizu ..... B65H 3/48 271/106
6,398,208 B1 * 6/2002 Yang ..... B65H 3/0883 271/106
8,387,968 B2 * 3/2013 Fujikura ..... B65H 1/14 271/157
9,359,157 B2 6/2016 Niikura et al.

FOREIGN PATENT DOCUMENTS

JP 2008-222404 A 9/2008
JP 2016-000653 A 1/2016

* cited by examiner

*Primary Examiner* — Howard J Sanders
(74) *Attorney, Agent, or Firm* — Oliff PLC

(57) ABSTRACT

A feeding apparatus for feeding a sheet-shaped medium includes: a stacking plate on which sheet-shaped media are stacked; a suction transport belt that is disposed above the stacking plate and causes a topmost one of the stacked sheet-shaped media to be sucked onto a belt lower surface and then rotates to carry out the topmost sheet-shaped medium to a destination; and a surrounding member that is provided in a hanging-down manner at least at left and right positions in a carrying-out direction around the suction transport belt so as to be movable up and down, surrounds a space below the belt lower surface, and is moved upward by contact with the sheet-shaped medium that is being sucked.

18 Claims, 13 Drawing Sheets

FEEDING APPARATUS FOR FEEDING SHEET-SHAPED MEDIUM, AND USING APPARATUS FOR USING SHEET-SHAPED MEDIUM

CROSS-REFERENCE TO RELATED APPLICATIONS

This application is based on and claims priority under 35 USC 119 from Japanese Patent Application No. 2021-086863 filed May 24, 2021.

BACKGROUND

(i) Technical Field

The present disclosure relates to a feeding apparatus for feeding a sheet-shaped medium, and a using apparatus for using a sheet-shaped medium.

(ii) Related Art

Japanese Unexamined Patent Application Publication No. 2008-222404 (see, for example, paragraph 0002, FIG. 1, and FIG. 4) describes a paper feeding apparatus having a suction transport unit that is provided above a bundle of sheets stacked on a paper feed plate, includes a suction chamber and a belt, and sucks a sheet of the bundle of the sheets by air and transports the sucked sheet in a paper feed direction.

SUMMARY

Aspects of non-limiting embodiments of the present disclosure relate to a feeding apparatus for feeding a sheet-shaped medium and a using apparatus for using a sheet-shaped medium that can improve suction force of a suction transport belt that causes a topmost one of sheet-shaped media stacked on a stacking plate to be sucked onto a lower surface of the belt and then rotates to transport the sucked sheet-shaped medium to a destination as compared with a case where the sheet-shaped medium is sucked without covering a lower side of the suction transport belt.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a feeding apparatus for feeding a sheet-shaped medium including: a stacking plate on which sheet-shaped media are stacked; a suction transport belt that is disposed above the stacking plate and causes a topmost one of the stacked sheet-shaped media to be sucked onto a belt lower surface and then rotates to carry out the topmost sheet-shaped medium to a destination; and a surrounding member that is provided in a hanging-down manner at least at left and right positions in a carrying-out direction around the suction transport belt so as to be movable up and down, surrounds a space below the belt lower surface, and is moved upward by contact with the sheet-shaped medium that is being sucked.

BRIEF DESCRIPTION OF THE DRAWINGS

Exemplary embodiments of the present disclosure will be described in detail based on the following figures, wherein.

DETAILED DESCRIPTION

Embodiments of the present disclosure are described below with reference to the drawings.

First Exemplary Embodiment

Figure 1:
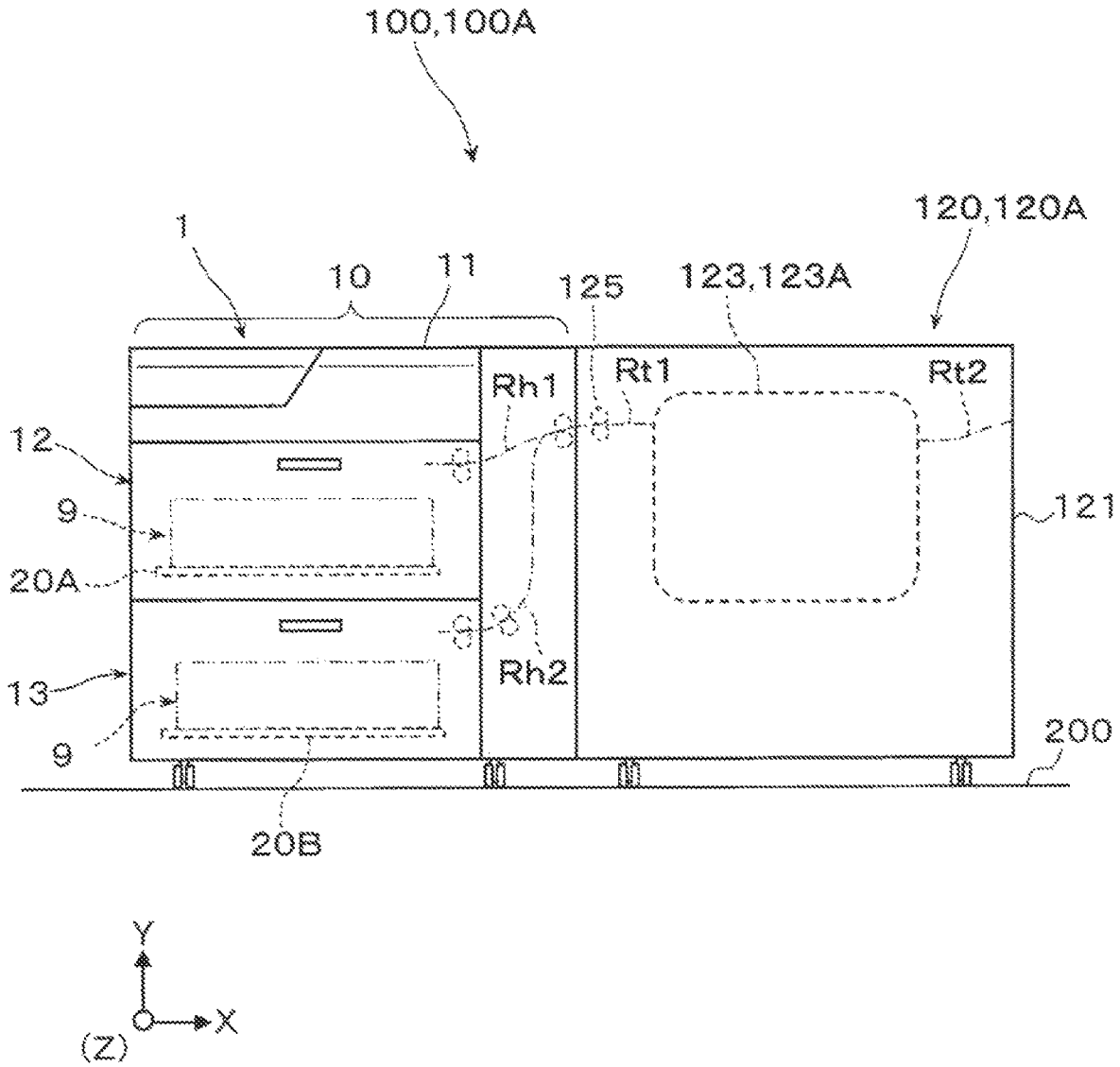
FIG. 1 is a side view of a using apparatus for using a sheet-shaped medium according to a first exemplary embodiment.
Figure 2:
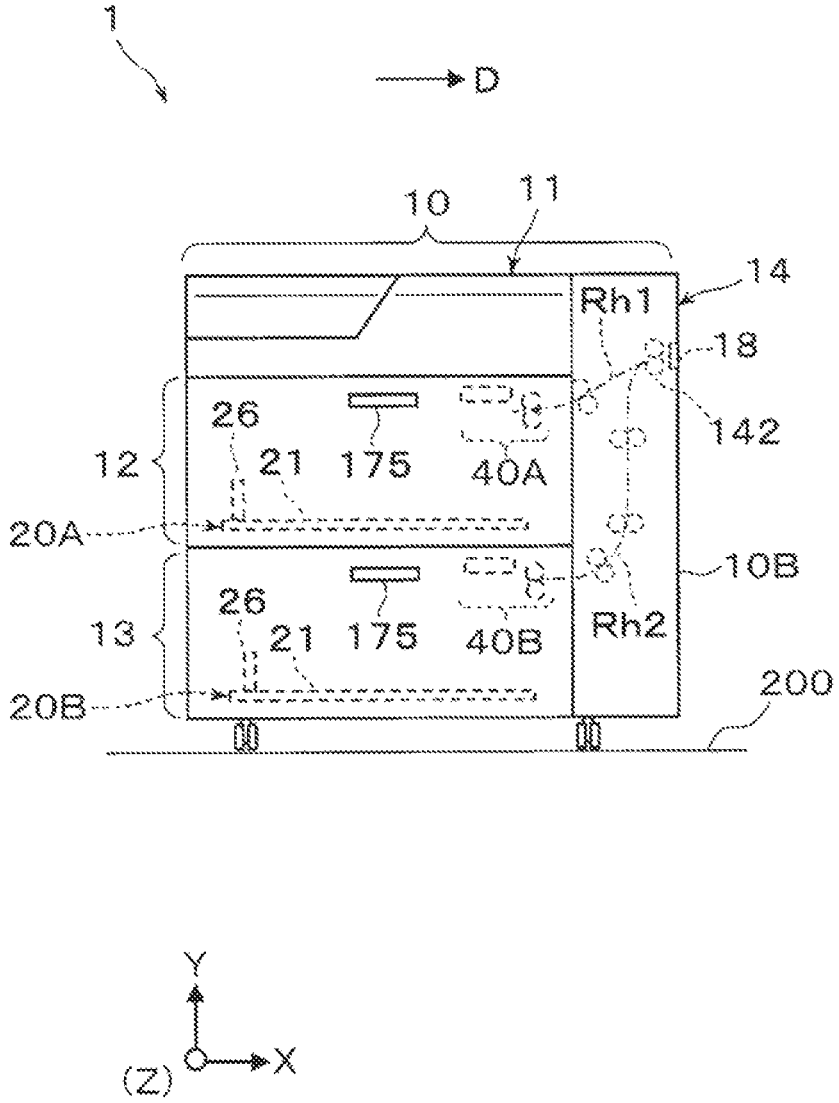
FIG. 2 is a side view of a feeding apparatus for feeding a sheet-shaped medium according to the first exemplary embodiment.

FIG. 1 illustrates a using apparatus 100 for using a sheet-shaped medium according to the first exemplary embodiment. FIG. 2 illustrates a feeding apparatus 1 for feeding a sheet-shaped medium according to the first exemplary embodiment.

In the following description, it is assumed that a direction indicated by arrow X, a direction indicated by arrow Y, and a direction indicated by arrow Z in the drawings are a width direction of the apparatus, a height direction of the apparatus, and a depth direction of the apparatus orthogonal to the width direction and the height direction, respectively. The circle mark at an intersection of arrow X and arrow Y in the drawings indicates that the depth direction (arrow Z) of the apparatus faces a downward direction orthogonal to the paper on which the drawings are drawn.

Using Apparatus for Using Sheet-Shaped Medium

As illustrated in FIG. 1, the using apparatus 100 for using a sheet-shaped medium includes the feeding apparatus 1 that carries out stacked sheet-shaped media 9 to feed the sheet-shaped media 9 and a processing apparatus 120 that performs processing on the sheet-shaped media] 9 fed from the feeding apparatus 1.

Each of the sheet-shaped media 9 is a medium having a sheet shape and can be stored in the feeding apparatus 1 and carried out from the feeding apparatus 1 and can be transported and processed in the processing apparatus 120. An image forming system 100A or the like is installed on a surface 200 illustrated in FIG. 1.

The using apparatus 100 for using a sheet-shaped medium employs, as the processing apparatus 120, an image forming apparatus 120A that forms an image on the sheet-shaped medium 9, which is connected to and combined with the feeding apparatus 1 to constitute the image forming system 100A.

As the sheet-shaped medium 9, a recording medium on which an image can be formed represented by a sheet cut to a predetermined size, coated paper, a film, a foil, a sheet-shaped cloth, an envelope, or the like is used.

As illustrated in FIG. 1, the image forming apparatus 120A, which is an example of the processing apparatus 120, has, in a housing 121 having a predetermined outer shape, an image forming unit 123A that forms an image on the sheet-shaped medium 9, which is an example of a processing unit 123, and a transport path Rt along which the sheet-shaped medium 9 is transported in the housing 121, and others.

The image forming unit 123A is, for example, a part realized by an image forming system such as an electrophotographic system or an ink recording method. The image forming unit 123A is not limited in particular in terms of a configuration such as an image forming system, a position, and the number.

An introducing transport path Rt1 indicated by the line with alternate long and short dashes in FIG. 1 transports the sheet-shaped medium 9 fed from the feeding apparatus 1 so as to introduce the sheet-shaped medium 9 into the image forming unit 123A and includes transport rolls 125 and a transport guide. A discharging transport path Rt2 indicated by the line with alternate long and short dashes transports the sheet-shaped medium 9 that has passed the image forming unit 123A so as to discharge the sheet-shaped medium 9 into a containing unit (not illustrated) or a post-processing unit and includes transport rolls and a transport guide (not illustrated).

In the image forming system 100A, when the sheet-shaped medium 9 is fed from the feeding apparatus 1 to the image forming apparatus 120A, which is an example of the processing apparatus 120, an image is formed on the sheet-shaped medium 9 in the image forming apparatus 120A.

Feeding Apparatus for Feeding Sheet-Shaped Medium

As illustrated in FIGS. 1 and 2, the feeding apparatus 1 for feeding a sheet-shaped medium has a housing 10, which is a body in which the sheet-shaped media 9 are contained and from which the sheet-shaped media 9 are fed.

Figure 3:
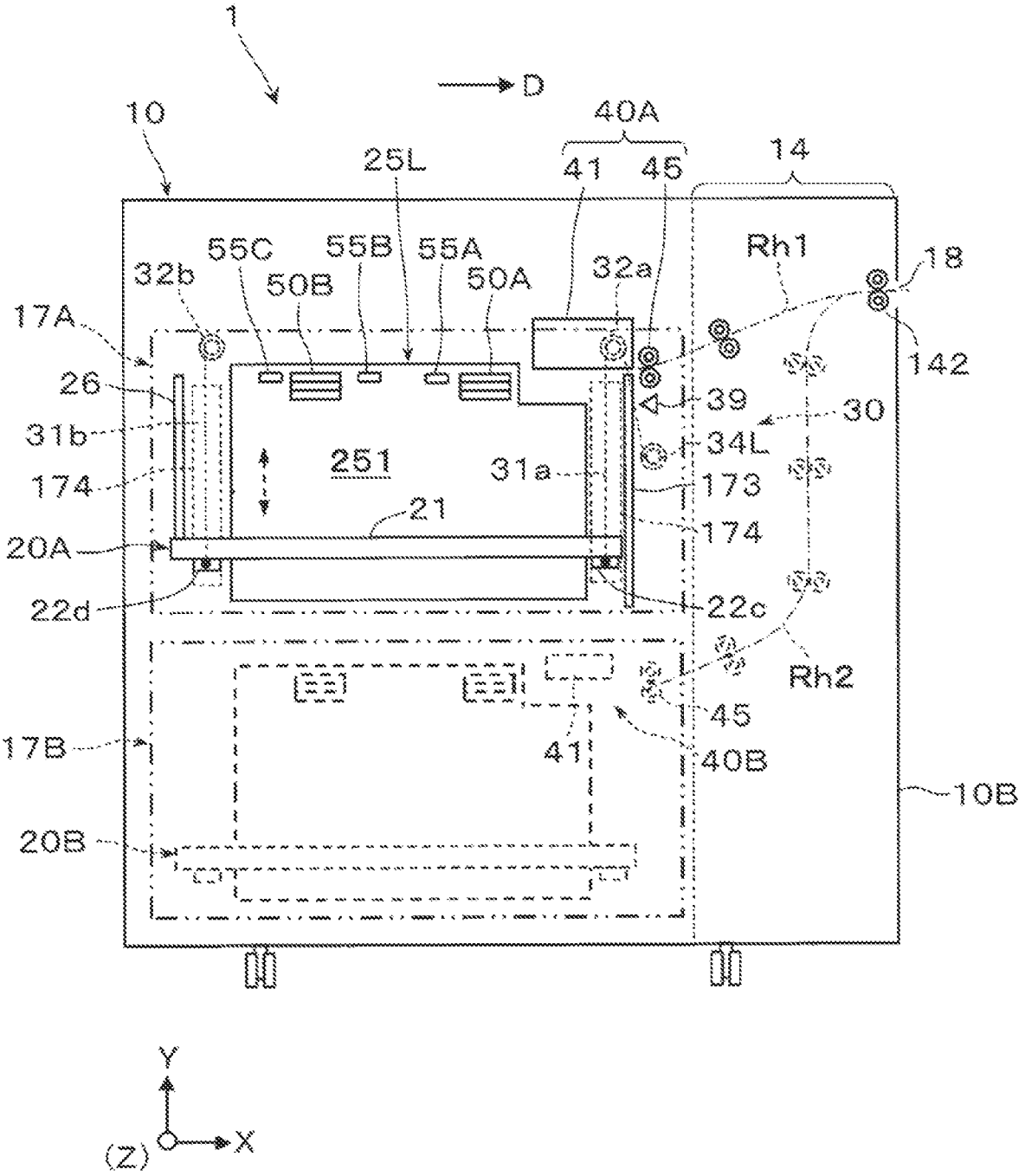
FIG. 3 is a schematic view of an inside of the feeding apparatus viewed from a side.

The housing 10 includes a support frame forming a predetermined skeletal structure and an exterior panel forming outer appearance. As illustrated in FIGS. 1 to 3, the housing 10 mainly includes an upper unit 11, and upper and lower (upper-stage and lower-stage) feeding units 12 and 13 provided below the upper unit 11, and a carrying-out unit 14 located at ends of the upper unit 11 and the feeding units 12 and 13 on one side.

As illustrated in FIGS. 1 to 4 and other drawings, the upper-stage feeding unit 12 and the lower-stage feeding unit 13 include containers 17A and 17B such as trays, stacking units 20A and 20B on which the sheet-shaped media 9 are stacked, lifting lowering units 30 that lift and lower the stacking units 20A and 20B in the containers 17A and 17B, and carrying-out units 40A and 40B that carry out the sheet-shaped medium 9 stacked on the stacking units 20A and 20B toward the carrying-out unit 14 in a direction (carrying-out direction D) indicated by arrow D, respectively.

First, the containers 17A and 17B are attached on a near side (upstream side in the apparatus depth direction Z) of the housing 10 so as to be withdrawable.

Each of the containers 17A and 17B includes a body having a side wall plate on an upstream end and a downstream end in the apparatus depth direction Z and opened in the apparatus width direction X. A front wall part 172 is attached to the side wall plate on the upstream side in the apparatus depth direction Z, and an opening 175 for gripping is provided in an upper part of the front wall part 172.

Furthermore, each of the containers 17A and 17Ba is provided with a front end wall 173 that determines positions of the sheet-shaped media 9 to be carried out stacked on the stacking unit 20A or 20B so that ends 9*s* of the sheet-shaped media 9 on a downstream side in the carrying-out direction D are lined up at one opened end (on the downstream side in the carrying-out direction D9) of the body and a moving device such as a slide rail and a latch mechanism (not illustrated) provided between left and right side parts of the body in a withdrawal direction and an inner wall part of the housing 10. A recessed part 173*b* having a cutout shape is formed at a center of an upper end of the front end wall 173, as illustrated in FIG. 4.

Next, the stacking units 20A and 20B are plate-shapes members (stacking plates) having, on an upper side thereof, a stacking surface 21 on which the sheet-shaped media 9 are stacked and are attached so as to be movable up and down in the containers 17A and 17B.

Since the stacking units 20A and 20B have an identical configuration, the following describes the stacking unit 20A as a representative if there is no particular necessity.

Figure 4:
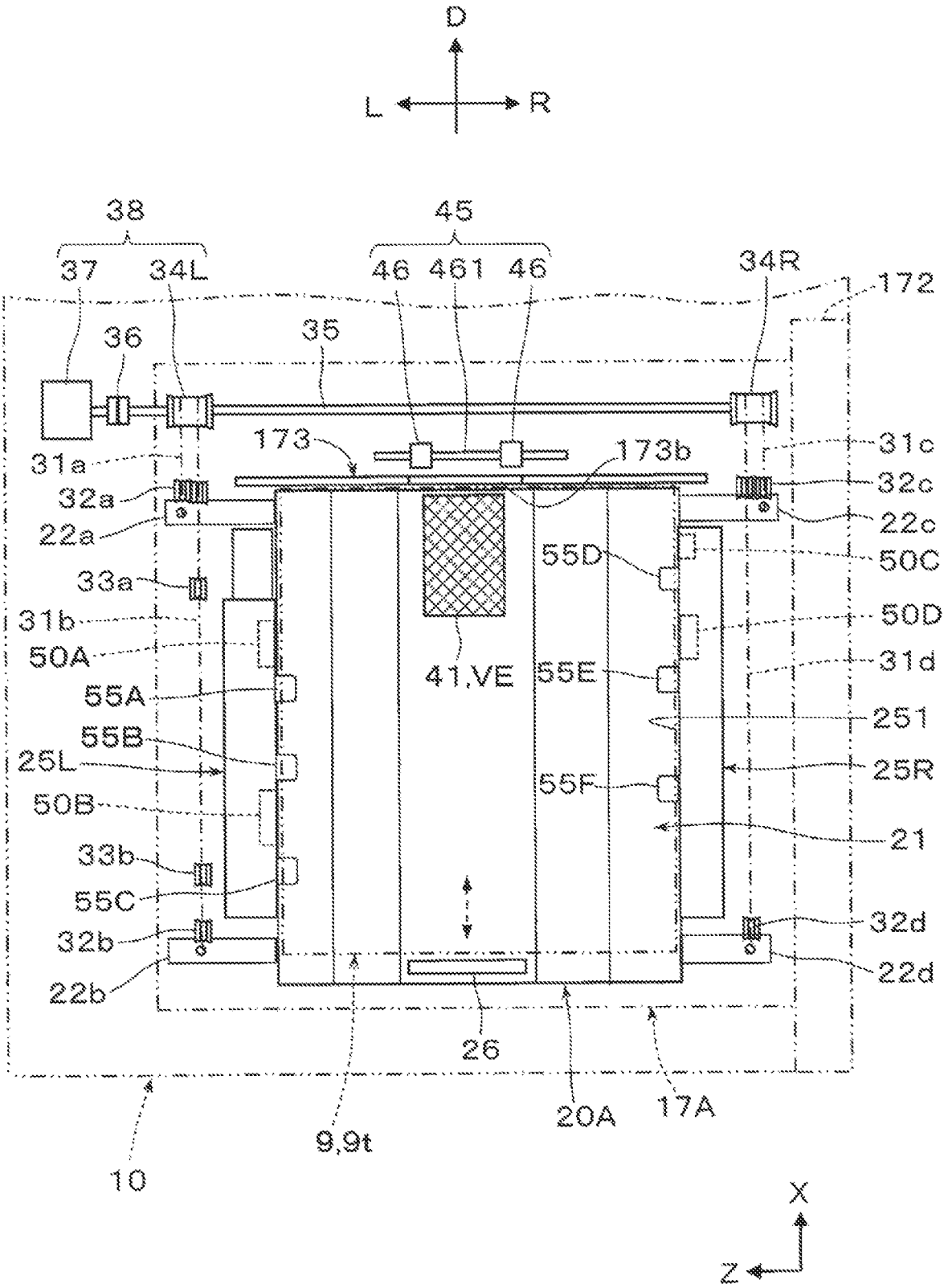
FIG. 4 is a schematic view of a part of the inside of the feeding apparatus viewed from an upper side.

As illustrated in FIGS. 3 and 4 and other drawings, the stacking unit 20A has suspension parts 22*a*, 22*b*, 22*c*, and 22*d* that protrude from left and right end portions thereof when viewed from a downstream side in the carrying-out direction D in which the sheet-shaped medium 9 is carried out, and the suspension parts 22*a*, 22*b*, 22*c*, and 22*d* are guided along guide holes 174 in the side wall plates of the body of the container 17A, so that the stacking unit 20A is movable up and down. The stacking unit 20A is movable by an amount corresponding to a length of the guide holes 174 in an up-down direction.

Furthermore, as illustrated in FIGS. 2 to 4 and other drawings, each of the stacking units 20A and 20B includes left and right side walls 25L and 25R that make contact with left and right side ends of the sheet-shaped media 9 to be carried out stacked on the stacking surface 21 and a rear end wall 26 that determines positions of the sheet-shaped media 9 so that rear ends thereof on an upstream side in the carrying-out direction D are lined up. The "left (L)" and "right (R)" as used herein refer to a left side and a right side when viewed from the upstream side in the carrying-out direction D as illustrated in FIG. 4.

The side walls 25L and 25R have contact surfaces 251 (FIG. 5) that make contact with left and right side ends of the sheet-shaped media 9. The side walls 25L and 25R employ a method (center register method) in which the feeding units 12 and 13 carry out the sheet-shaped medium 9 while using a central position of the sheet-shaped medium 9 in a feeding width direction as a reference position during carrying out. In this respect, the whole side walls 25L and 25R are movable in the left and right directions L and R on bottoms of the containers 17A and 17B. With this configuration, the side walls 25L and 25R are moved to positions of the left and right side ends of the sheet-shaped media 9 and adjust the positions of the sheet-shaped media 9 so that the left and right side ends are fixedly lined up.

The rear end wall 26 has a contact surface that makes contact with rear ends of the sheet-shaped media 9, and the whole rear end wall 26 is movable along a slide groove formed along the carrying-out direction D on a fixing surface part 21A of the stacking surface 21. With this configuration, the rear end wall 26 is moved to the position of the rear ends of the sheet-shaped media 9 and thus adjusts the positions of the sheet-shaped media 9 so that the rear ends of the sheet-shaped media 9 are fixedly lined up.

Next, in the case of the stacking unit 20A, the lifting lowering unit 30 includes four wires 31*a*, 31*b*, 31*c*, and 31*d* whose ends are linked to the suspension parts 22*a*, 22*b*, 22*c*, and 22*d* provided at four portions of the stacking unit 20A, respectively, as illustrated in FIGS. 3 and 4 and other drawings.

The lifting lowering unit 30 includes suspension pulleys 32*a*, 32*b*, 32*c*, and 32*d* rotatably attached to upper portions of upper ends of the guide holes 174 of the container 17A, a left winding pulley 34L that winds up the wires 31*a* and 31*b* disposed on the left side, a right winding pulley 34R that winds up the wires 31*c* and 31*d* disposed on the right side, and auxiliary pulleys 33*a* and 33*b* on which the wires 31*a* and 31*b* are suspended so as to follow a necessary path between the suspension pulleys 32*a* and 32*b* and the left winding pulley 34L.

As illustrated in FIG. 4, the lifting lowering unit 30 is configured such that the left winding pulley 34L and the right winding pulley 34R are connected by a rotary shaft 35, and an end of the rotary shaft 35 on the left winding pulley 34L side is connected to (a drive shaft of) a driving device 37 including a motor and a gear mechanism with a coupling mechanism 36 that is detachable interposed therebetween. In the lifting lowering unit 30, a winding unit 38 is constituted by the left winding pulley 34L, the right winding pulley 34R, and the driving device 37, and the wires 31*a*, 31*b*, 31*c*, and 31*d* are wound up and unwounded by operation of the winding unit 38.

In the lifting lowering unit 30, in a case where the driving device 37 operates to wind up the wires 31*a*, 31*b*, 31*c*, and 31*d*, the stacking units 20A and 20B move upward, whereas in a case where detection information of a position sensor 39 is obtained, driving of the driving device 37 is stopped. As a result, the upward movement of the stacking unit 20A by the lifting lowering unit 30 stops when an uppermost part of the sheet-shaped media 9 reaches a predetermined height.

The position sensor 39 detects a position of the uppermost part of the sheet-shaped media 9 stacked on the stacking unit 20A. The position sensor 39 is, for example, disposed so as to be capable of detecting a position of the uppermost part of the sheet-shaped media 9 seen from the cutout part 173*b* of the front end wall 173 of the container 17A.

The side walls 25L and 25R have, in the contact surfaces 251 thereof, air exhaust openings 50 through which air is ejected to the left and right side ends of the sheet-shaped media 9 stacked on the stacking units 20A and 20B, as illustrated in FIGS. 3 and 4 and other drawings.

As illustrated in FIG. 4 and other drawings, the air exhaust openings 50 include two air exhaust openings 50A and 50B provided in the left side wall 25L so as to be spaced apart from each other in the carrying-out direction D and two air exhaust openings 50C and 50D provided in the right side wall 25R so as to be spaced apart from each other in the carrying-out direction D. Among these air exhaust openings, the air exhaust opening 50A and the air exhaust opening 50D face each other in the carrying-out direction D.

The air exhaust openings 50A and 50B are connected to a fan duct including a fan (not illustrated) disposed on an outer side (on a side opposite to the contact surface 251) of the left side wall 25L. Meanwhile, the air exhaust openings 50C and 50D are connected to a fan duct including a fan (not illustrated) disposed on an outer side (on a side opposite to the contact surface 251) of the right side wall 25R.

In the feeding units 12 and 13, by ejecting air from the air exhaust openings 50A, 50B, 50C, and 50D, air is blown to left and right side ends of upper some of the sheet-shaped media 9 stacked on the stacking unit 20A and 20B so that these sheet-shaped media 9 are floated and separated in the up-down direction.

Furthermore, as illustrated in FIG. 3 and other drawings, the side walls 25L and 25R has, on the contact surfaces 251 thereof, plural limiting units 55 that limit a height of the sheet-shaped media 9 stacked on the stacking units 20A and 20B to a predetermined height by making contact with left and right ends of an upper surface of the sheet-shaped media 9.

As illustrated in FIGS. 3 and 4 and other drawings, the limiting units 55 include, on the left side wall 25L, one limiting unit 55A located on an upstream side relative to the air exhaust opening 50A in the carrying-out direction D and two limiting units 55B and 55C located on both a downstream side and an upstream side of the air exhaust opening 50B in the carrying-out direction D. Furthermore, as illustrated in FIG. 4 and other drawings, the limiting units 55 include, on the right side wall 25R, one limiting unit 55D provided between the air exhaust opening 50C and the air exhaust opening 50D and two limiting units 55E and 55F provided on a downstream side of the air exhaust opening 50D in the carrying-out direction D.

These limiting units 55A to 55F are, for example, constituted by plate-shaped members that protrude from predetermined height positions of the contact surfaces 251 of the side walls 25L and 25R toward positions above the stacking surfaces 21 of the stacking units 20A and 20B so as to have a predetermined length. The limiting units 55A to 55F are, for example, stored inside the side walls 25L and 25R so as not to protrude from the contact surfaces 251 during work of stacking the sheet-shaped media 9 on the stacking surfaces 21 of the stacking units 20A and 20B (when the stacking unit 20A and the like have moved to a lowermost position).

In the feeding units 12 and 13, the limiting units 55A to 55F hold, from an upper side, left and right side ends of the sheet-shaped media 9 (actually the topmost sheet-shaped medium 9*t*) floated by air ejected from the air exhaust openings 50 as described above, thereby stopping the floating sheet-shaped media 9 to a predetermined height above the stacking surfaces 21 of the stacking units 20A and 20B.

Next, as illustrated in FIGS. 2 to 4 and other drawings, each of the carrying-out units 40A and 40B includes a suction unit 41 that carries the topmost sheet-shaped medium 9*t* among the sheet-shaped media 9 stacked on the stacking unit 20A or 20B while sucking the topmost sheet-shaped medium 9*t*, a transport unit 45 that carries out the sheet-shaped medium 9 sucked by the suction unit 41, and a guide member (not illustrated) that constitutes a first carrying-out path Rh1, which will be described later.

The carrying-out units 40A and 40B are fixed to a part of the housing 10, for example, to an inner frame 19 independently of the containers 17A and 17B. With this configuration, the carrying-out units 40A and 40B are fixed at constant positions in the housing 10 without moving even when the containers 17A and 17B are drawn out to an outside of the housing 10.

As illustrated in FIGS. 3 to 6 and other drawings, each of the suction units 41 in the carrying-out units 40A and 40B is disposed so that a part thereof faces the stacking surface 21 of the stacking unit 20A or 20B at an upper position in the container 17A or 17B on a downstream side in the carrying-out direction D. This part is a part including at least a suction region VE of a lower surface of a suction transport belt 43 (described later) where suction force is generated.

The suction unit 41 is a suction belt transport mechanism that causes the topmost sheet-shaped medium 9*t* to be sucked onto a lower surface of the belt and then rotates to carry out the topmost sheet-shaped medium 9*t* to a destination.

The suction belt transport mechanism includes an upstream-side roll 42A rotatably disposed on an upstream side in the carrying-out direction D, a downstream-side roll 42B rotatably disposed on a downstream side in the carrying-out direction D, the suction transport belt 43 having a large number of air-intake holes 431 evenly distributed in the belt surface and suspended across the upstream-side roll 42A and the downstream-side roll 42B, and a suction box 44 disposed on an inner side of the suction transport belt 43 and gives suction force on the lower surface of the belt by suction air.

The upstream-side roll 42A and the downstream-side roll 42B are rotatably attached to an attachment frame 412 (see FIG. 4) fixed to the inner frame 19 or the like of the housing 10. The downstream-side roll 42B is disposed on a downstream side in the carrying-out direction D relative to the front end wall 173 in the container 17A or the like. Furthermore, the downstream-side roll 42B is a drive roll that is driven in a direction indicated by the broken-line arrow (see FIG. 6 and other drawings) by rotary power transmitted from the driving device such as a motor and a power transmission mechanism (not illustrated).

Figure 5:
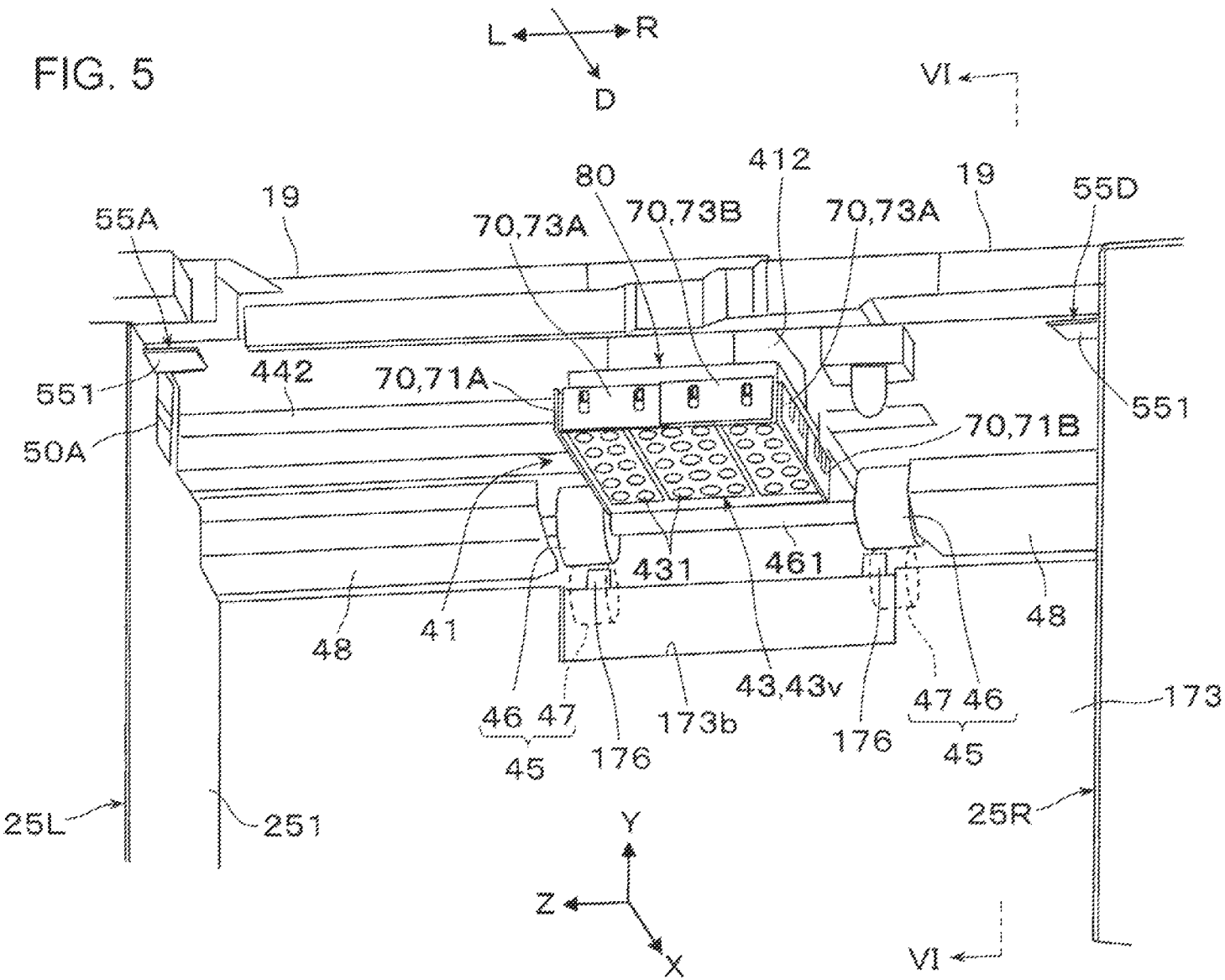
FIG. 5 is a schematic view of members such as a suction unit and a transport unit of the feeding apparatus viewed from a diagonally lower side.
Figure 6:
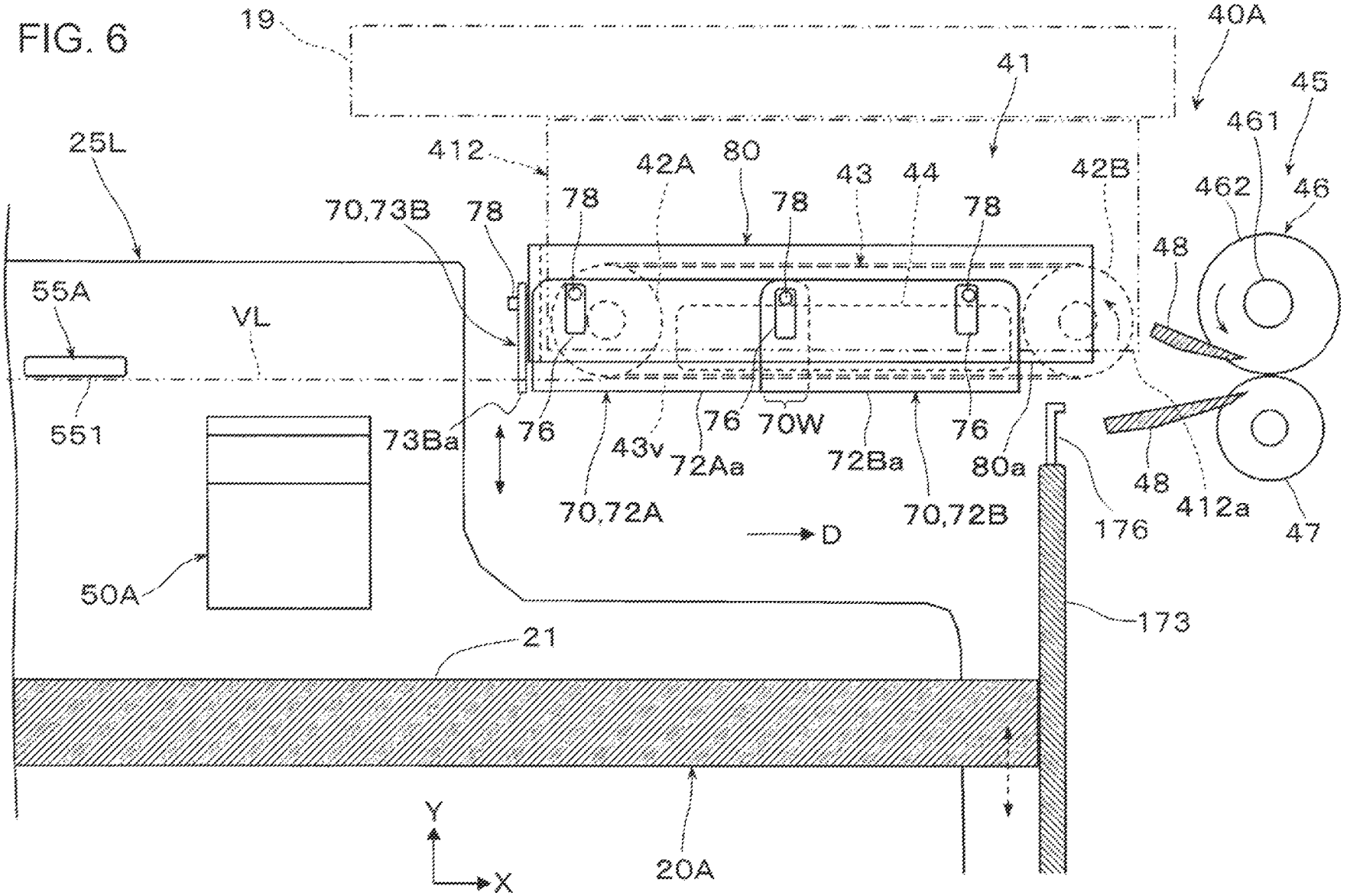
FIG. 6 is a schematic view illustrating a partial cross section of the feeding apparatus taken along line VI-VI in FIG. 5.

As illustrated in FIGS. 5 and 6 and other drawings, the suction transport belt 43 is suspended so as to keep predetermined tension between the upstream-side roll 42A and the downstream-side roll 42B and is rotated so that a belt lower surface 43*v* travelling on a lower side of the roll 42A and the roll 42B move along the carrying-out direction D. Furthermore, in relation to the position of the downstream-side roll 42B, the suction transport belt 43 is disposed so that an end thereof on a downstream side in the carrying-out direction D protrudes toward the downstream side in the carrying-out direction D beyond the front end wall 173, as illustrated in FIGS. 6 and 7 and other drawings. Although the suction transport belt 43 is often constituted by plural suction transport belts extending in left and right directions substantially orthogonal to the carrying-out direction D, it is assumed in the following description that the suction transport belt 43 is constituted by a single suction transport belt.

The suction box 44 is disposed in a space between the upstream-side roll 42A and the downstream-side roll 42B on an inner side of the suction transport belt 43. This suction box 44 is disposed so that an air sucking part provided on a lower surface of the box is in proximity with or in contact with an inner circumferential surface of the belt lower surface 43*v* of the suction transport belt 43. Furthermore, the suction box 44 is connected to an air sucking device (not illustrated) through a duct 422 (see FIG. 5), which is an air pipe.

Figure 7A:
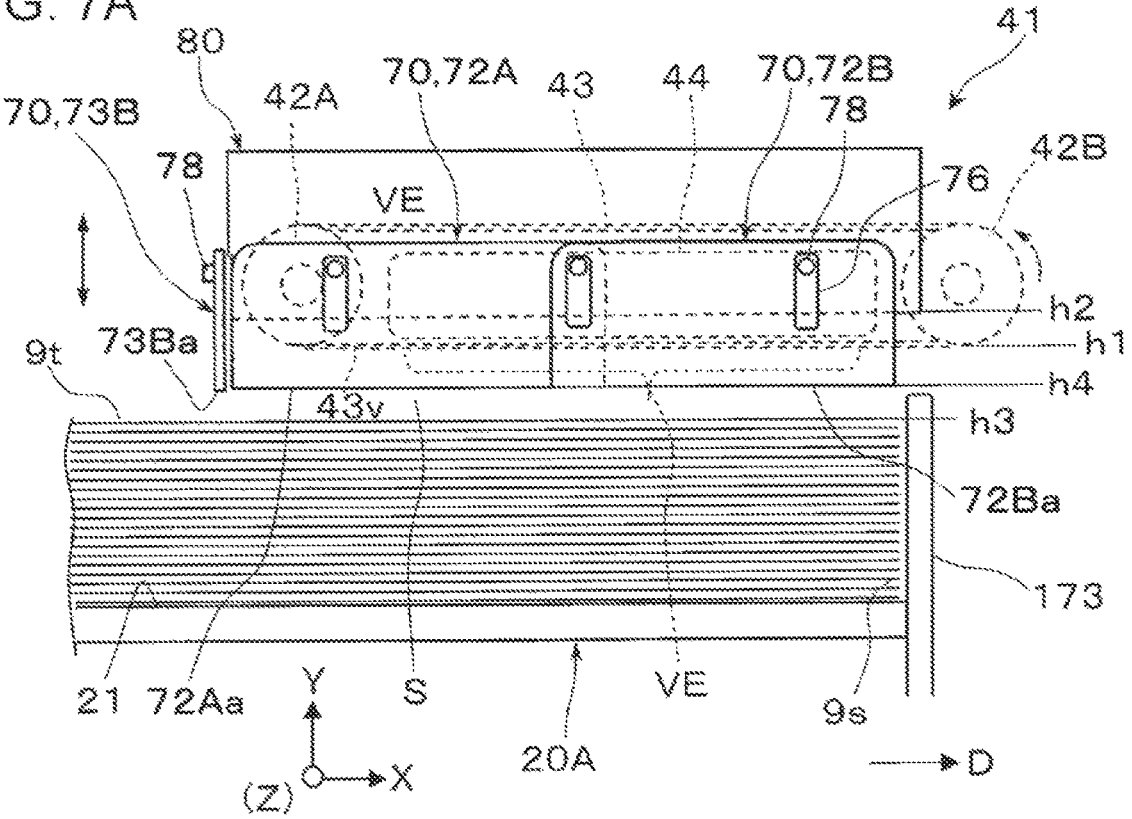
FIG. 7A is a schematic view illustrating members such as a surrounding member of the suction unit.
Figure 7B:
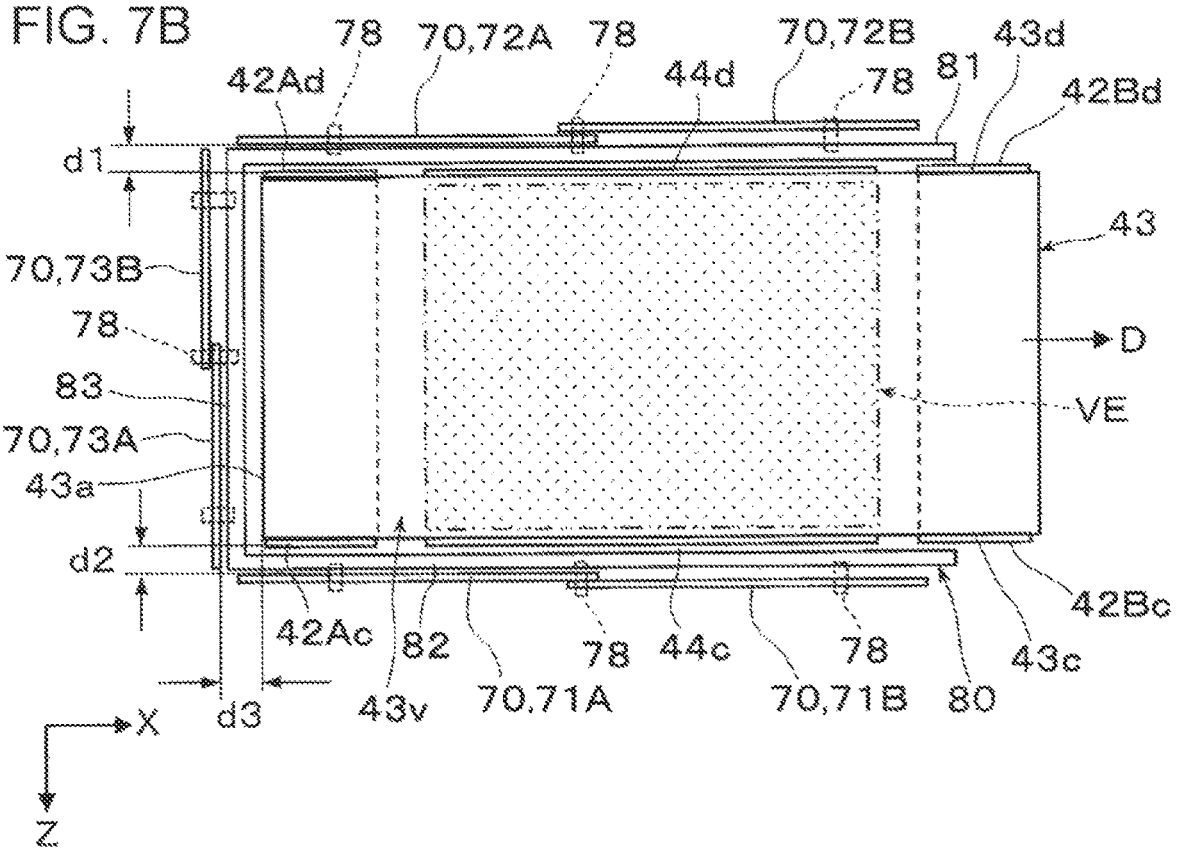
FIG. 7B is a schematic view of the suction unit of FIG. 7A viewed from a lower side.

As illustrated in FIGS. 7A and 7B, in the suction unit 41, a region of the belt lower surface 43*v* of the suction transport belt 43 that faces the air sucking part provided on the lower surface of the suction box 44 functions as the suction region VE. With this configuration, in the suction unit 41, the sheet-shaped medium 9 is sucked in contact with a part of the belt lower surface 43*v* that functions as the suction region VE.

The suction unit 41 according to the present exemplary embodiment is configured so that the suction region VE exists as a region having an area facing an almost central portion of the stacking surface 21 of the stacking unit 20A or 20B in the left and right directions L and R crossing the carrying-out direction D at a position closer to an end on a downstream side in the carrying-out direction D, as illustrated in FIGS. 4 and 6.

Next, the transport units 45 in the carrying-out units 40A and 40B are disposed on a downstream side in the carrying-out direction D relative to the suction unit 41 on an outer side, which is a downstream side in the carrying-out direction D, relative to the front end wall 173 in the containers 17A and 17B.

As illustrated in FIGS. 5 and 6, the transport units 45 include a pair of transport rolls constituted by driving transport rolls 46, which are transport rolls 462 attached to a rotary shaft 461, and driven transport rolls 47 that are driven to rotate in contact with lower portions of the driving transport rolls 46 and a transport guide member (not illustrated) that forms a space in which the first carrying-out path Rh1 passes. The rotary shaft 461 is driven to rotate during carrying-out operation by a driving device such as a motor (not illustrated).

An introduction guide member 48 in FIGS. 5 and 6 guides a front end of the sheet-shaped medium 9 to be carried out so that the front end is introduced between rolls (contact portions between the driving transport rolls 46 and the driven transport rolls 47) of the transport units 45.

As illustrated in FIGS. 2 and 3, the carrying-out unit 14 in the housing 10 includes the first carrying-out path Rh1 along which the sheet-shaped medium 9 carried out from the upper-stage feeding unit 12 by the carrying-out unit 40A is carried out to an outside and a second carrying-out path Rh2 along which the sheet-shaped medium 9 carried out from the lower-stage feeding unit 13 by the carrying-out unit 40B is carried out to an outside.

The first carrying-out path Rh1 and the second carrying-out path Rh2 are discharging transport paths that are disposed so as to merge in the way to discharging rolls 142 of a discharging opening 18 provided on the other side part 10B of the housing 10 and each include a pair of transport rolls indicated by the broken line and a transport guide member (not illustrated).

Surrounding Member in Feeding Apparatus

In the feeding apparatus 1, a surrounding member 70 is provided at least on the left L and right R of the carrying-out direction D around the suction transport belt 43 in the suction unit 41, as illustrated in FIGS. 5 to 7 and other drawings.

The surrounding member 70 hangs down so as to be movable up and down, surrounds at least a part of a space S below the belt lower surface 43*v* of the suction transport belt 43, and is moved upward by making contact with the sheet-shaped medium 9 sucked by the suction unit 41.

The surrounding member 70 is constituted by a member having such a degree of strength to keep a substantially identical shape even after receiving suction force of the suction unit 41 and having such a degree of lightness in weight to be moved upward by making contact with the sheet-shaped medium sucked by the suction unit 41. Specifically, for example, a sheet made of a synthetic resin such as polyethylene terephthalate (PET) or polycarbonate (PC) is applied as the surrounding member 70.

In the present exemplary embodiment, the surrounding member 70 includes a left surrounding member 71 and a right surrounding member 72 that are provided on the left L and the right R of the carrying-out direction D around the suction transport belt 43 and an upstream surrounding member 73 that is provided on an upstream side in the carrying-out direction D relative to the left surrounding member 71 and the right surrounding member 72.

The surrounding member 70 including the left surrounding member 71, the right surrounding member 72, and the upstream surrounding member 73 is disposed so as to surround three sides, specifically, left and right peripheral positions and an upstream-side peripheral position in the carrying-out direction D around the suction transport belt 43.

In this case, the duct 442 connected to the suction box 44 is sometimes present as an obstacle in either the peripheral position on the left L or the peripheral position on the right R in the carrying-out direction D around the suction transport belt 43. In this case, however, for example, it is only necessary to dispose the duct 442 so that the duct 442 is connected on an upper side of the suction box 44 and to secure a space in which either the left surrounding member 71 or the right surrounding member 72 that overlaps at least the duct 442 in the up-down direction is stored (evacuates) when being moved upward by the topmost sheet-shaped medium 9A sucked onto the suction unit 41.

Furthermore, the surrounding member 70 is disposed at peripheral positions around a portion of the suction transport belt 43 that faces an upper surface of the sheet-shaped media 9 stacked on the stacking surface 21 of the stacking unit 20A except for a peripheral position around an end of the suction transport belt 43 protruding beyond the front end wall 173 of the container 17A toward a downstream side in the carrying-out direction D, as illustrated in FIGS. 6 and 7A. Accordingly, the left and right surrounding members 71 and 72 are disposed only in positions around the portion facing the upper surface of the stacked sheet-shaped media 9 except for left and right peripheral positions around the end of the suction transport belt 43 protruding beyond the front end wall 173 toward a downstream side in the carrying-out direction D.

Each of the left surrounding member 71, the right surrounding member 72, and the upstream surrounding member 73 that constitute the surrounding member 70 includes two divided surrounding members (a first divided surrounding member and a second divided surrounding member) arranged side by side in a peripheral position in which the surrounding member is disposed, as illustrated in FIG. 7B and other drawings.

Specifically, the left surrounding member 71 includes a first divided surrounding member 71A and a second divided surrounding member 71B arranged side by side, the right surrounding member 72 includes a second divided surrounding member 72A and a second divided surrounding member 72B arranged side by side, and the upstream surrounding member 73 includes a second divided surrounding member 73A and a second divided surrounding member 73B.

Furthermore, the surrounding member 70 constituted by the left surrounding member 71, the right surrounding member 72, and the upstream surrounding member 73 is attached in a hanging-down manner so as to be movable up and down to a support frame 80 separate from the attachment frame 412 to which the suction belt transport mechanism of the suction unit 41 is attached, as illustrated in FIGS. 4 to 7.

First, the support frame 80 is, for example, a frame having three side plates (left and right side plates 81 and 82 and an upstream side plate 83) that surround left and right peripheral portions of the suction transport belt 43 and an upstream-side peripheral portion of the suction transport belt 43 in the carrying-out direction D, as illustrated in FIG. 7B.

This support frame 80 is disposed around the attachment frame 412 of the suction unit 41 on an outer side of the attachment frame 412. Furthermore, although the support frame 80 can be fixed to the attachment frame 412 of the suction unit 41, the support frame 80 is preferably attached to a portion such as the inner frame 19 of the housing 10 independently of the attachment frame 412, for example, from the perspective of preventing the surrounding member 70 from receiving operational vibration of the suction belt transport mechanism.

Each of the left surrounding member 71, the right surrounding member 72, and the upstream surrounding member 73 has plural guide holes 76 extending in the up-down direction so as to have a predetermined length. Each of the divided surrounding members 71A, 71B, 72A, 72B, 73A, and 73B has two guide holes 76.

Meanwhile, the support frame 80 has protrusions 78 inserted into the guide holes 76 with a sufficient gap at positions corresponding to the plural guide holes 76 of the surrounding members 71 to 73 in outer surfaces of the side plates 81 to 83 where the surrounding members 71 to 73 are attached.

Since the protrusions 78 of the support frame 80 are inserted into the two guide holes 76 of each of the divided surrounding members 71A, 71B, 72A, 72B, 73A, and 73B, the left surrounding member 71, the right surrounding member 72, and the upstream surrounding member 73 are attached in a hanging-down manner so as to be movable up and down along the guide holes 76 into which the protrusions 78 are inserted.

The divided surrounding members 71A, 71B, 72A, 72B, 73A, and 73B of the surrounding member 70 are desirably attached in a manner such that approximately ½ to ⅓ thereof from an upper side in the up-down direction is supported in contact with external surfaces of the side plates 81, 82, and 83 of the support frame 80, for example, from the perspective of smooth movement in the up-down direction.

As illustrated in FIG. 6 and other drawings, the divided surrounding members 71A, 71B, 72A, 72B, 73A, and 73B are disposed so that adjacent two divided surrounding members partially overlap in a central part in a peripheral position where the divided surrounding members are disposed and one protrusion 78 provided corresponding to an overlapping portion 70W is inserted into one of the guide holes 76 of each of the adjacent two divided surrounding members.

This prevents an unnecessary gap from being generated between adjacent two of the divided surrounding members 71A, 71B, 72A, 72B, 73A, and 73B.

Furthermore, a measure exemplified below for preventing the guide holes 76 from being easily detached from the protrusions 78 is taken for the divided surrounding members 71A, 71B, 72A, 72B, 73A, and 73B. Specifically, a measure selected from among measures represented by shaping front ends of the protrusions 78 so that the guide holes 76 are hard to be detached from the protrusions 78, attaching a component for preventing detachment to the front ends of the protrusions 78, and attaching a covering member (covering) that covers the protrusions 78 and the guide holes 76 from outer sides is taken.

A member having a horizontally-long rectangular shape is applied as each of the left surrounding member 71, the right surrounding member 72, and the upstream surrounding member 73.

The shape of each of the left surrounding member 71, the right surrounding member 72, and the upstream surrounding member 73 is not limited to the above shape and can be any shape that meets at least the following conditions. Specifically, each of the surrounding members 71, 72, and 73 has a shape such that a lower portion thereof can surrounds the space S below the belt lower surface 43*v* of the suction transport belt 43 by a predetermined height, and a lower end of each of the surrounding members 71, 72, and 73 (e.g., a lower end 72Aa of the first divided surrounding member 72A and a lower end 72Ba of the second divided surrounding member 72B of the right surrounding member 72, and a lower end 73Ba of the second divided surrounding member 73B of the upstream surrounding member) have a linear end shape almost parallel with the stacking surface 21 of the stacking unit 20A.

Furthermore, the surrounding member 70 constituted by the left surrounding member 71, the right surrounding member 72, and the upstream surrounding member 73 is disposed in the following state.

Specifically, as illustrated in FIG. 7A, each of the surrounding members 71, 72, and 73 is disposed so that a height position h4 of a lower end thereof (e.g., the lower end 72Aa of the first divided surrounding member 72A and the lower end 72Ba of the second divided surrounding member 72B of the right surrounding member 72) is lower than a height h1 of the belt lower surface 43*v* of the suction transport belt 43 and higher than a height position h3 of the topmost sheet-shaped medium 9*t* stacked on the stacking surface 21 of the stacking unit 20A at a time of feeding.

A height position h2 in FIG. 7A is a lower one of a lower end 412*a* (see FIG. 6) of the attachment frame 412 of the suction unit 41 and a lower end 80*a* (see FIG. 6) of the support frame 80, and is assumed to be a height position of the lower end 80*a* of the support frame 80 in FIG. 7A. The height position h2 is higher than the height h1 of the belt lower surface 43*v* of the suction transport belt 43.

As illustrated in FIGS. 5 to 7, the left surrounding member 71, the right surrounding member 72, and the upstream surrounding member 73 are configured such that height positions of lower ends thereof are lined up at the same height during a non-suction state in which the sheet-shaped medium 9 is not sucked onto the suction unit 41.

The divided surrounding members 71A, 71B, 72A, 72B, 73A, and 73B according to the exemplary embodiment are also configured such that lower ends of adjacent divided surrounding members are lined up at the same height during a non-suction state in which the sheet-shaped medium 9 is not sucked.

Furthermore, the upstream surrounding member 73 according to the present exemplary embodiment is disposed so that a minimum interval d3 thereof from the suction transport belt 43 is wider than minimum intervals d1 and d2 of the left and right surrounding members 71 and 72 from the suction transport belt 43 (d3>d1, d3>d2), as illustrated in FIG. 7B.

Although overlapping ones of the divided surrounding members 71A, 71B, 72A, 72B, 73A, and 73B are different in minimum interval d1, d2, or d3, a relatively small interval is used as the minimum interval (d1, d2, or d3).

The minimum intervals d1 and d2 have no particular problem as long as left and right ends of the suction transport belt 43 are located on outermost sides in the left and right directions in the suction belt transport mechanism. However, as illustrated in FIG. 7B, left and right ends 42Ac and 42Ad of the upstream roll 42A, left and right ends 42Bc and 42Bd of the downstream roll 42B, or left and right ends 44Bc and 44Bd of the suction box 44 sometimes protrude to outermost sides relative to left and right ends 43*c* and 43*d* of the suction transport belt 43.

In this case, the minimum intervals d1 and d2 are intervals not from the left and right ends 43*c* and 43*d* of the suction transport belt 43 but from the protruding outermost ends.

Sheet-Shaped Medium Feeding Operation

Next, operation for feeding the sheet-shaped medium 9 by the feeding apparatus 1 for feeding a sheet-shaped medium is described.

This operation is described below by using the upper-stage feeding unit 12. In the feeding apparatus 1, first, operation of concurrently winding up the wires 31*a*, 31*b*, 31*c*, 31*d* by the lifting lowering unit 30A starts. This causes the stacking unit 20A to move upward in the container 17A until a topmost one of the sheet-shaped media 9 stacked on the stacking surface 21 of the stacking unit 20A reaches a predetermined feeding preparation height (h3), as illustrated in FIG. 7A.

Figure 8A:
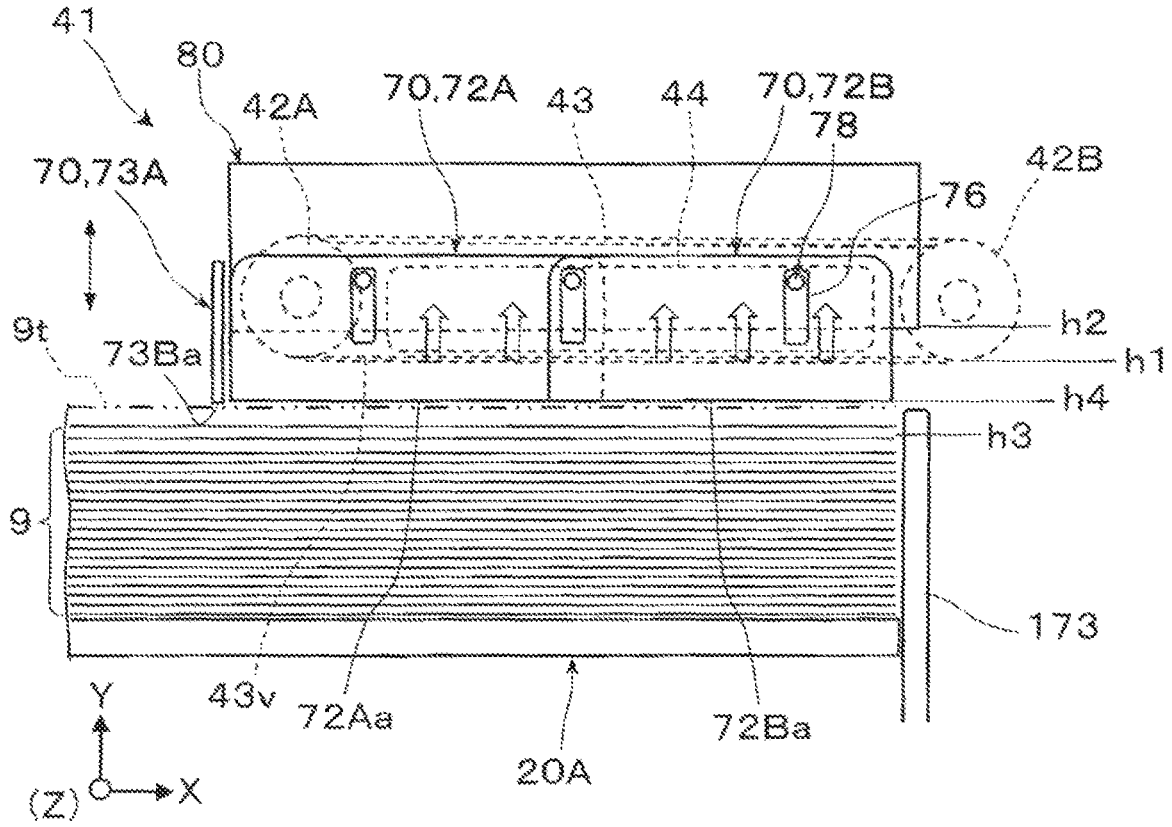
FIG. 8A is a schematic view of one operation state of the suction unit.

Then, in the stacking unit 20A, air is ejected from the air exhaust openings 50A, 50B, 50C, and 50D of the left and right side walls 25L and 25R, as illustrated in FIG. 8A. This causes plural sheet-shaped media 9 on an upper side among the stacked sheet-shaped media 9 to float upward and be separated from each other due to inflow of the air.

Although the plural sheet-shaped media 9 float to move upward, left and right ends of an upper surface of the topmost sheet-shaped medium 9*t* make contact with the contact surfaces 551 of the limiting units 55A to 55F. This blocks the upward movement of the plural sheet-shaped media 9, thereby restricting a height of the plural sheet-shaped media 9.

A height of the contact surfaces 551 of the limiting units 55A to 55F is, for example, set to a height almost identical to the height position (h1) of the belt lower surface 43*v* of the suction transport belt 43, as illustrated in FIG. 6. The line with alternate long and two short dashes VL in FIG. 6 is a virtual extended straight line passing the height position (h1) of the belt lower surface 43*v*.

Furthermore, in the carrying-out unit 40A, air-sucking operation of the suction box 44 in the suction unit 41 starts, and sucking operation of the suction unit 41 starts. As a result, suction force from the suction box 44 acts on the belt lower surface 43*v* of the suction transport belt 43 to form the suction region VE, as illustrated in FIGS. 7A and 7B and 8A. At this time, the suction transport belt 43 is not rotating.

When the sucking operation starts, the topmost sheet-shaped medium 9*t* among the plural floated sheet-shaped media 9 starts to move upward in the container 17A so that a front end portion thereof in the carrying-out direction D approaches the belt lower surface 43*v* of the suction transport belt 43 by receiving the suction force from the suction region VE of the suction transport belt 43 in the suction unit 41.

At this time, in the suction unit 41, the left surrounding member 71, the right surrounding member 72, and the upstream surrounding member 73 (strictly, the divided surrounding members 71A, 71B, 72A, 72B, 73A, and 73B) that constitute the surrounding member 70 are provided in left and right peripheral positions around the suction transport belt 43 and a peripheral position on an upstream side in the carrying-out direction D around the suction transport belt 43, and therefore the space S below the belt lower surface 43*v* of the suction transport belt 43 is surrounded on three sides (the left and right peripheral positions and the peripheral position on an upstream side in the carrying-out direction D).

Accordingly, a gap between the belt lower surface 43*v* of the suction transport belt 43 and the upper surface of the topmost sheet-shaped medium 9*t* is reduced, the space S below the belt lower surface 43*v* of the suction transport belt 43 is more likely to be in a negative pressure state than a case where the surrounding member 70 is not provided, and suction force on the belt lower surface 43*v* of the suction transport belt 43 is concentrated on an upper surface portion of the topmost sheet-shaped medium 9*t* that faces the suction region VE and thus the suction force improves.

In the suction unit 41, the space S below the belt lower surface 43*v* is not surrounded by providing the surrounding member 70 in a peripheral position around a portion of the suction transport belt 43 protruding toward a downstream side in the carrying-out direction D relative to the front end wall 173 of the container 17A. However, since sufficient suction force is obtained on the suction region VE of the belt lower surface 43*v* in the protruding portion of the suction unit 41, there is no particular need to improve the suction force by providing the surrounding member 70 around the protruding portion, and therefore there is no problem.

As a result, the front end portion of the topmost sheet-shaped medium 9*t* on a downstream side in the carrying-out direction D makes contact with the lower ends of the left surrounding member 71, the right surrounding member 72, and the upstream surrounding member 73 that constitute the surrounding member 70 during upward movement toward the suction region VE by the suction force from the suction region VE on the belt lower surface 43*v* of the suction transport belt 43, as illustrated in FIG. 8A.

Since the lower ends of the left surrounding member 71, the right surrounding member 72, and the upstream surrounding member 73 are lined up at the same height position (h4) before suction, the suction force of the belt lower surface 43*v* acts almost evenly on the front end portion of the sheet-shaped medium 9*t*, and the front end portion of the sheet-shaped medium 9*t* makes contact with the lower ends almost concurrently.

Figure 8B:
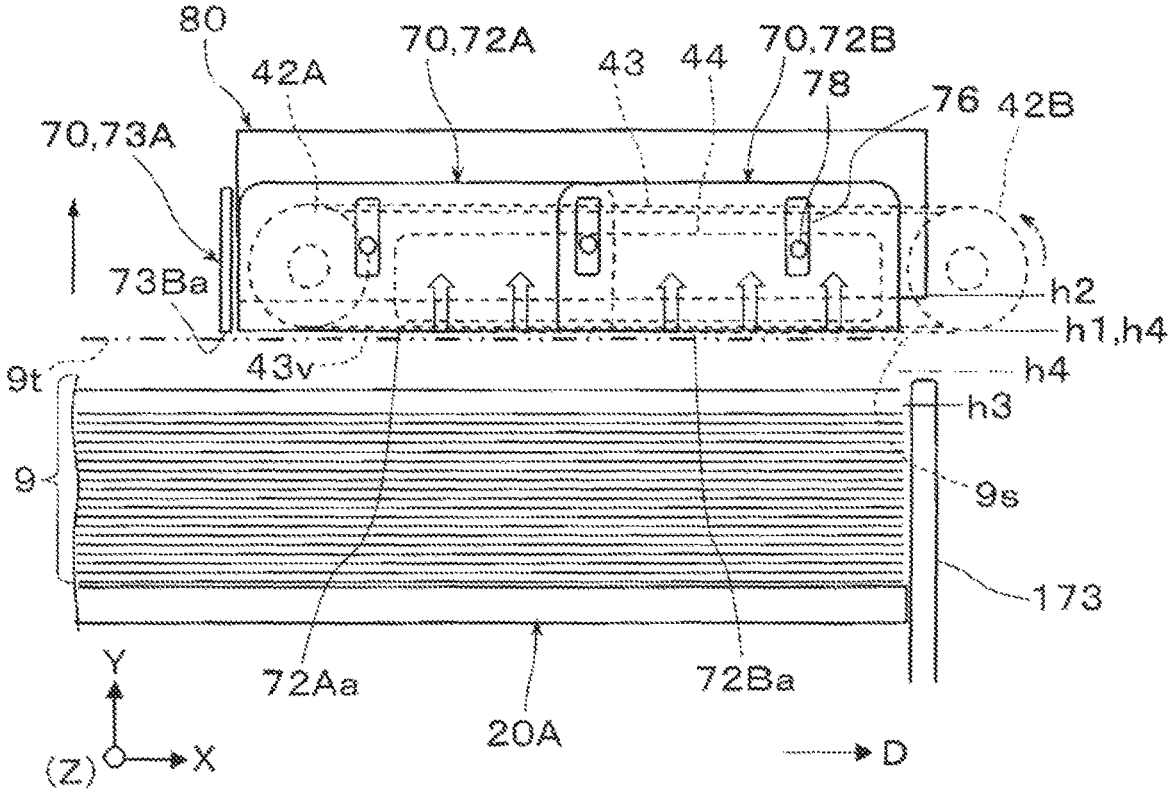
FIG. 8B is a schematic view of a next operation state of the suction unit.

Next, as illustrated in FIG. 8B, the front end portion of the topmost sheet-shaped medium 9*t* moves upward together with the left surrounding member 71, the right surrounding member 72, and the upstream surrounding member 73 that constitute the surrounding member 70 and is finally sucked onto the suction region VE of the belt lower surface 43*v*.

The left surrounding member 71, the right surrounding member 72, and the upstream surrounding member 73 that constitute the surrounding member 70 are pushed upward by the front end portion of the topmost sheet-shaped medium 9*t* that moves upward. As a result, (the height position h4 of) the lower ends of the left surrounding member 71, the right surrounding member 72, and the upstream surrounding member 73 becomes almost identical to the height position h1 of the suction region VE on the belt lower surface 43*v* of the suction transport belt 43.

Accordingly, the surrounding members 71, 72, and 73 of the surrounding member 70 do not inhibit suction movement of the topmost sheet-shaped medium 9*t* onto the suction unit 41.

Next, in the feeding apparatus 1, when the suction unit 41 of the carrying-out unit 40A detects suction of the topmost sheet-shaped medium 9*t*, the suction transport belt 43 starts to rotate in a predetermined direction. This detection is, for example, performed by a detector (not illustrated) that is provided in a portion such as the housing 10 close to an end of the suction transport belt 43 on an upstream side in the carrying-out direction D and detects a height of the topmost sheet-shaped medium 9A.

As a result, the topmost sheet-shaped medium 9*t* sucked onto the suction region VE of the belt lower surface 43*v* of the suction transport belt 43 is carried out in the carrying-out direction D by rotation of the suction transport belt 43, and the front end 9*s* on a downstream side in the carrying-out direction D is delivered to the transport unit 45. That is, the front end 9*s* of the sheet-shaped medium 9*t* is introduced into the contact portions between the driving transport rolls 46 and the driven transport rolls 47, which are a pair of rolls in the transport unit 45.

After the operation of delivering the sucked sheet-shaped medium 9*t* to the transport unit 45 is finished, the suction unit 41 stops the rotating operation of the suction transport belt 43 and stops the sucking operation of the suction box 44 until next feeding operation starts.

Next, the transport unit 45 of the carrying-out unit 40A carries out the delivered sheet-shaped medium 9*t* from the stacking unit 20A and the container 17A by carrying-out force to deliver the sheet-shaped medium 9*t* to the first carrying-out path Rh1.

At this time, the sheet-shaped medium 9*t* moves in the carrying-out direction D while the left and right ends thereof are being guided in contact with the contact surfaces 251 of the left and right side walls 25L and 25R. This allows the sheet-shaped medium 9*t* to be carried out in a normal state without being inclined during transport.

In this way, from the upper-stage feeding unit 12, the sheet-shaped medium 9 is discharged from the discharging opening 18 through the first carrying-out path Rh1 and is then fed to (the first introducing transport path Rt1) of the image forming apparatus 120A, which is an example of a destination.

In the feeding apparatus 1, also from the lower-stage feeding unit 13, the sheet-shaped medium 9 stacked on the stacking unit 20B is discharged from the discharging opening 18 through the second carrying-out path Rh2 and is then supplied to a destination in an almost similar manner to the feeding operation in the upper-stage feeding unit 12.

In the using apparatus 100 for using a sheet-shaped medium, when the sheet-shaped medium 9 is fed from the feeding apparatus 1 to the image forming apparatus 120A, which is an example of the processing apparatus 120, an image is formed on the sheet-shaped medium 9.

In the feeding apparatus 1, which employs a system in which the sheet-shaped medium 9 is sucked once by the suction unit 41 in the upper-stage feeding unit 12 and the lower-stage feeding unit 13 and is then carried out, the sheet-shaped medium 9 is carried out after being sucked well since sufficient suction force is obtained on the suction transport belt 43 of the suction unit 41.

Furthermore, since the sheet-shaped medium 9 is carried out after being sucked well onto the suction transport belt 43 in the feeding apparatus 1, failure to feed the sheet-shaped medium 9 to the image forming apparatus 120A, which is a processing device for processing the sheet-shaped medium 9, due to insufficiency of suction force of the suction transport belt 43 is less likely to occur in the using apparatus 100.

Figure 9:
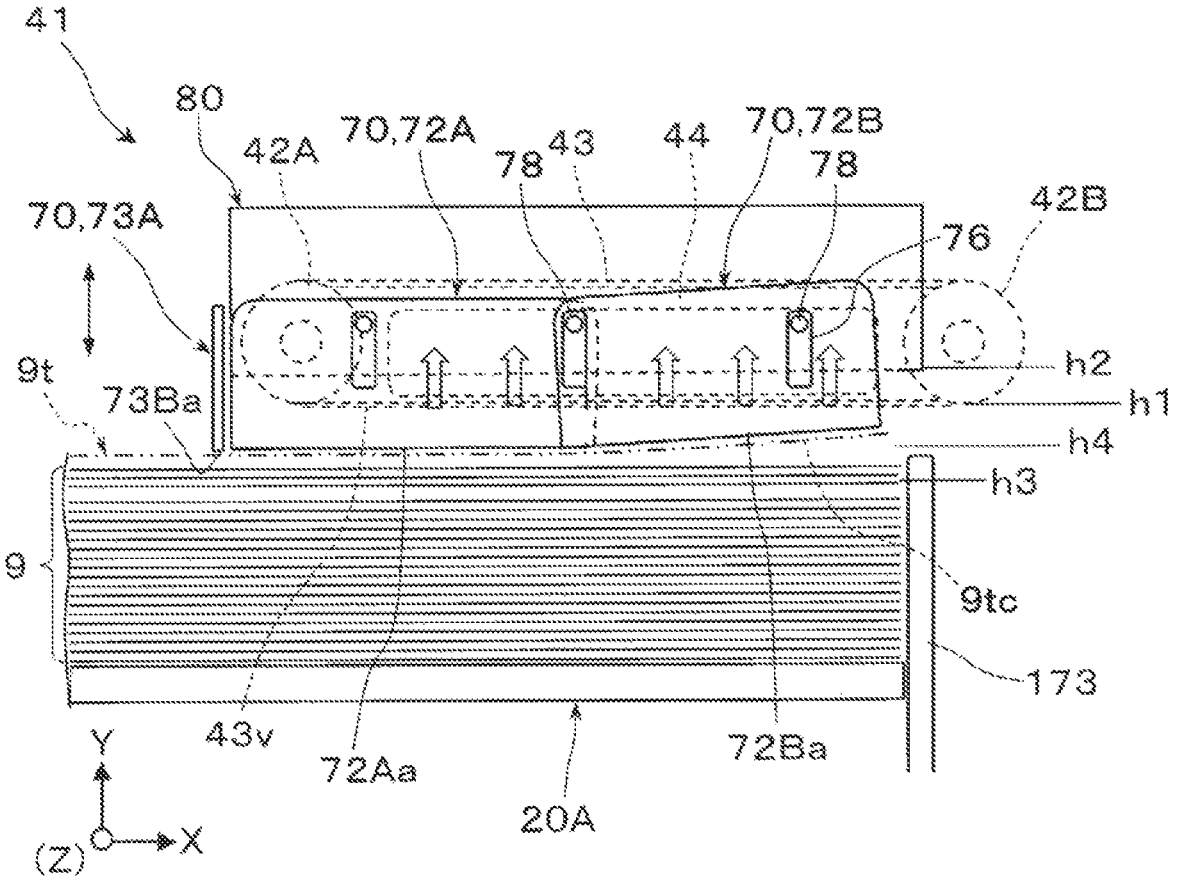
FIG. 9 is a schematic view of another operation state of the surrounding member of the suction unit.

In the feeding apparatus 1, the sheet-shaped medium 9*t* to be sucked onto the belt lower surface 43*v* of the suction transport belt 43 in the suction unit 41 sometimes makes contact with the lower ends 71Ba and 72Ba of the left and right second divided surrounding members 71B and 72B (the left second divided surrounding member 71B and the lower end 71Ba thereof are omitted in FIG. 9) constituting the surrounding member 70 at a timing different from a timing of contact with the other divided surrounding members, as illustrated in FIG. 9.

Even in this case, in the suction transport belt 43, ends, in a downstream side in the carrying-out direction D, of the left and right second divided surrounding members 71B and 72B of the surrounding member 70 move upward earlier than portions (e.g., ends in an upstream side in the carrying-out direction D) of the other divided surrounding members so as to follow this suction state of the sheet-shaped medium 9*t*.

As a result, the suction force of the suction transport belt 43 flexibly acts on the sheet-shaped medium 9*t*. FIG. 9 illustrates a case where the front end portion of the sheet-shaped medium 9*t* on a downstream side in the carrying-out direction D makes contact with ends of the left and right second divided surrounding members 71B and 72B on a downstream side in the carrying-out direction D at a different timing slightly earlier than the other portions. Alternatively, for example, an overlapping portion between adjacent divided surrounding members may move upward earlier than the other portions or an end of the first divided surrounding member on an upstream side in the carrying-out direction D moves upward earlier than the other portions.

The difference in timing of contact of the sheet-shaped medium 9*t* occurs, for example, due to fluctuation in suction force or presence of a curved portion of the sheet-shaped medium 9.

Furthermore, in the suction unit 41 of the feeding apparatus 1, when suction force is generated on the belt lower surface 43*v* of the suction transport belt 43, the left and right surrounding members 71 and 72 and the upstream surrounding member 73 are not deformed toward the suction transport belt 43 due to influence of the suction force and there is almost no risk of contact with the suction transport belt 43.

Furthermore, in the suction unit 41, there is no possibility that the upstream surrounding member 73 makes contact with and is caught up by an end 43*a* of the suction transport belt 43 on an upstream side in the carrying-out direction D since the relatively large interval d3 is secured from the end 43*a* of the suction transport belt 43 in the carrying-out direction D although there sometimes is influence of the suction force generated on the belt lower surface 43*v* of the suction transport belt 43 and influence of airflow generated by rotation of the suction transport belt 43.

Second Exemplary Embodiment

Figure 10A:
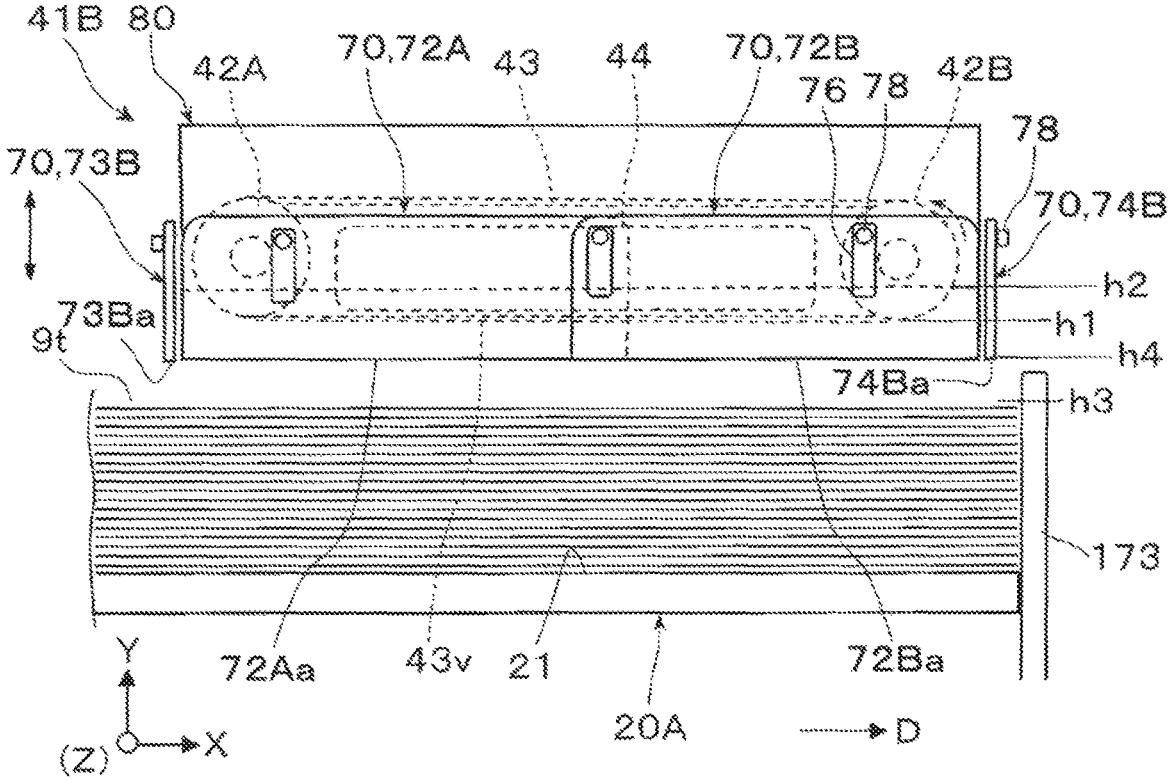
FIG. 10A is a schematic view of a suction unit and others of a feeding apparatus according to a second exemplary embodiment.
Figure 10B:
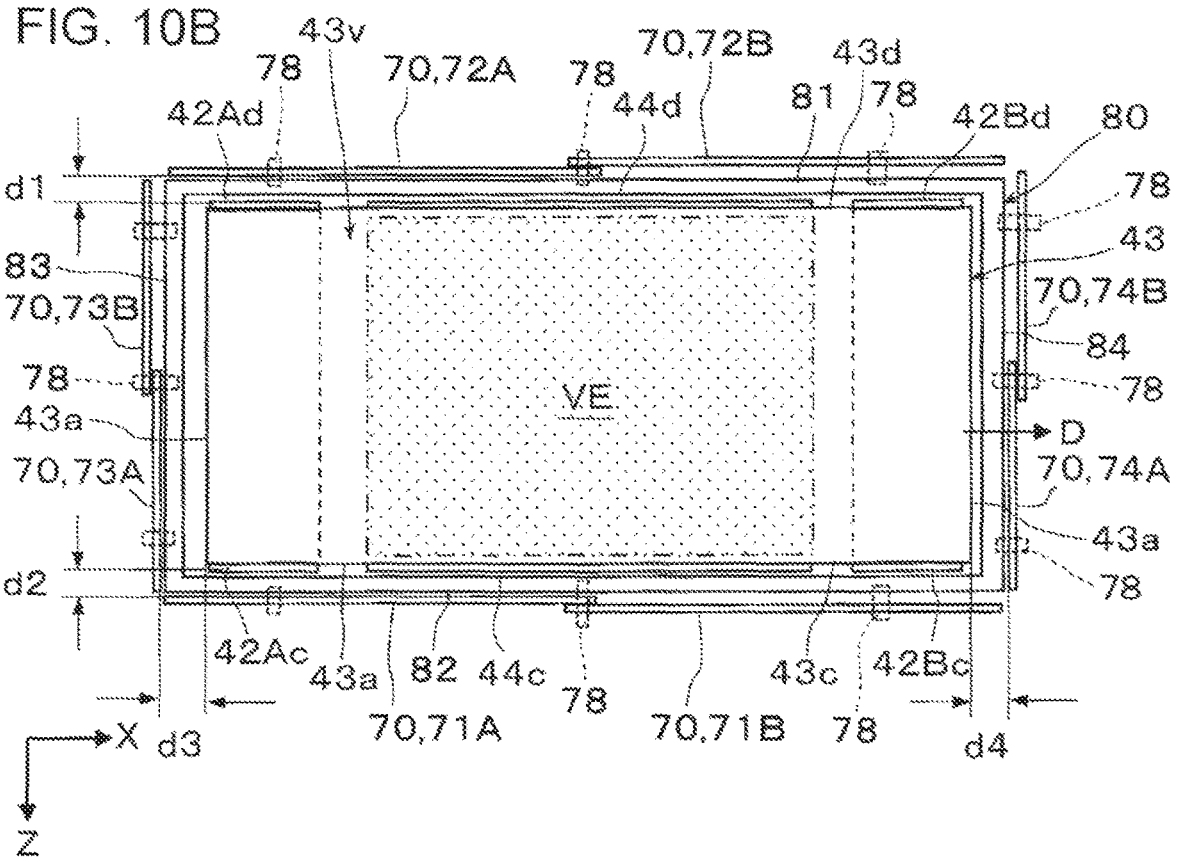
FIG. 10B is a schematic view of the suction unit viewed from a lower side.

FIGS. 10A and 10B illustrate a part (a suction unit and others) of a feeding apparatus 1 for feeding a sheet-shaped medium according to a second exemplary embodiment.

The feeding apparatus 1 according to the second exemplary embodiment has a configuration identical to the feeding apparatus 1 according to the first exemplary embodiment except for that the feeding apparatus 1 according to the second exemplary embodiment includes a suction unit 41B. In the following description, identical constituent parts are given reference signs identical to those used in the first exemplary embodiment, and description thereof is omitted unless there is necessity.

As illustrated in FIG. 10A, the suction unit 41B according to the second exemplary embodiment has a configuration identical to the suction unit 41 according to the first exemplary embodiment except for that a position of a suction transport belt 43 is changed and a surrounding member 70 is partially changed.

The suction transport belt 43 in the suction unit 41B is disposed so that a belt lower surface 43*v* (including a downstream-side roll 42B) faces an inner portion of an upper surface of sheet-shaped media 9 stacked on a stacking surface 21 of a stacking unit 20A. Accordingly, the suction transport belt 43 has no portion (including the downstream-side roll 42B) that protrudes toward a downstream side in a carrying-out direction D relative to a front end wall 173 of a container 17A.

Furthermore, in the suction unit 41B, as a surrounding member 70, a left surrounding member 71 and a right surrounding member 72 are provided on left L and right R in the carrying-out direction D around the suction transport belt 43 so as to extend to the downstream-side roll 42B, an upstream surrounding member 73 is provided on an upstream side in the carrying-out direction D around the suction transport belt 43, and additionally a downstream surrounding member 74 is provided on a downstream side in the carrying-out direction D around the suction transport belt 43. The downstream surrounding member 74 includes two divided surrounding members arranged side by side in a peripheral position where the downstream surrounding member 74 is disposed, as with the other surrounding members 71, 72, and 73. Specifically, the downstream surrounding member 74 includes a first divided surrounding member 74A and a second divided surrounding member 74B, as illustrated in FIG. 10B.

In the suction unit 41B, a frame having a downstream side plate 84 that surrounds a periphery of the suction transport belt 43 on a downstream side in the carrying-out direction D in addition to left and right side plates 81 and 82 and an upstream side plate 83 is applied as a support frame 80 in relation to addition of the downstream surrounding member 74, as illustrated in FIG. 10B.

Furthermore, as illustrated in FIG. 10B, the upstream surrounding member 73 and the downstream surrounding member 74 in the suction unit 41B are disposed so that minimum intervals d3 and d4 thereof from the suction transport belt 43 are wider than minimum intervals of the left and right surrounding members 71 and 72 from the suction transport belt 43 (d4>d1, d4>d2).

Furthermore, as illustrated in FIG. 10B, the upstream surrounding member 73 is disposed so that the minimum interval d3 thereof from the suction transport belt 43 is wider than the minimum interval d3 of the downstream surrounding member 74 from the suction transport belt 43 (d3>d4), for example, from the perspective of avoiding contact with the suction transport belt 43 with certainty.

Sheet-Shaped Medium Feeding Operation

Operation of feeding the sheet-shaped medium 9 by the feeding apparatus 1 for feeding a sheet-shaped medium is identical to the feeding operation by the feeding apparatus 1 according to the first exemplary embodiment except for that operation of the suction unit 41B is partially changed as described below.

That is, in the feeding apparatus 1, when sucking operation of the suction box 44 in the suction unit 41B starts, a topmost sheet-shaped medium 9*t* among plural floated sheet-shaped media 9 starts to move upward in the container 17A so that a front end portion thereof in the carrying-out direction D approaches the belt lower surface 43*v* of the suction transport belt 43 by receiving suction force from the suction region VE of the suction transport belt 43 in the suction unit 41B.

At this time, in the suction unit 41B, the left surrounding member 71, the right surrounding member 72, the upstream surrounding member 73, and the downstream surrounding member 74 (strictly, the divided surrounding members 71A, 71B, 72A, 72B, 73A, 73B, 74A, and 74B) that constitute the surrounding member 70 are provided in left and right peripheral positions, a peripheral position on an upstream side in the carrying-out direction D, and a peripheral position on a downstream side in the carrying-out direction D around the suction transport belt 43, and therefore a space S below the belt lower surface 43*v* of the suction transport belt 43 is surrounded on four sides (the left and right peripheral positions, the peripheral position on an upstream side in the carrying-out direction D, and the peripheral position on a downstream side in the carrying-out direction D).

Accordingly, a gap between the belt lower surface 43*v* of the suction transport belt 43 and the upper surface of the topmost sheet-shaped medium 9*t* is reduced, the space S below the belt lower surface 43*v* of the suction transport belt 43 is more likely to be in a negative pressure state than a case where the surrounding member 70 is not provided, and suction force on the belt lower surface 43*v* of the suction transport belt 43 is concentrated on an upper surface portion of the topmost sheet-shaped medium 9*t* that faces the suction region VE and thus the suction force improves.

Figure 11A:
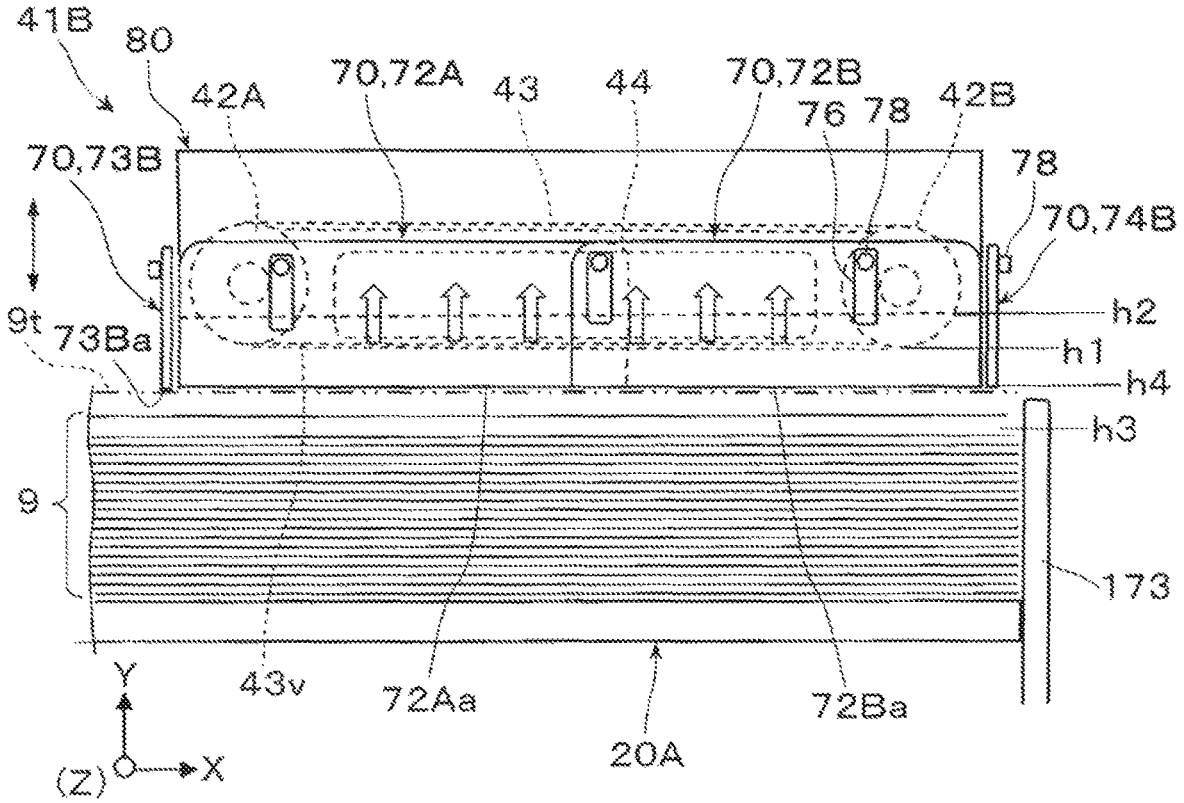
FIG. 11A is a schematic view of one operation state of the suction unit of FIG. 10.

As a result, the front end portion of the topmost sheet-shaped medium 9*t* on a downstream side in the carrying-out direction D makes contact with the lower ends of the left surrounding member 71, the right surrounding member 72, the upstream surrounding member 73, and the downstream surrounding member 74 that constitute the surrounding member 70 during upward movement toward the suction region VE by the suction force from the suction region VE on the belt lower surface 43*v* of the suction transport belt 43, as illustrated in FIG. 11A.

Since the lower ends of the left surrounding member 71, the right surrounding member 72, the upstream surrounding member 73, and the downstream surrounding member 74 are lined up at the same height position (h4) before suction, the suction force of the belt lower surface 43*v* acts almost evenly on the front end portion of the sheet-shaped medium 9*t*, and the front end portion of the sheet-shaped medium 9*t* makes contact with the lower ends almost concurrently.

Figure 11B:
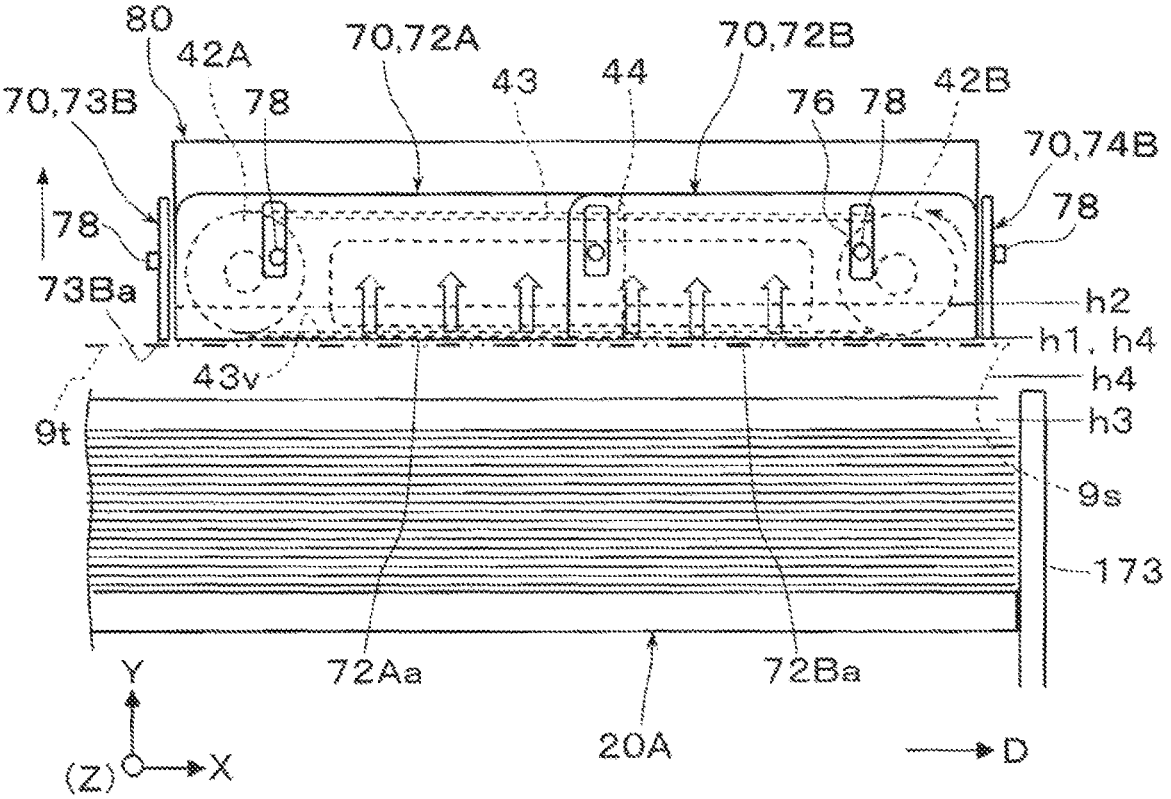
FIG. 11B is a schematic view of a next operation state of the suction unit.

Next, as illustrated in FIG. 11B, the front end portion of the topmost sheet-shaped medium 9*t* moves upward together with the left surrounding member 71, the right surrounding member 72, the upstream surrounding member 73, and the downstream surrounding member 74 that constitute the surrounding member 70 and is finally sucked onto the suction region VE of the belt lower surface 43*v*.

The left surrounding member 71, the right surrounding member 72, the upstream surrounding member 73, and the downstream surrounding member 74 that constitute the surrounding member 70 are pushed upward by the front end portion of the topmost sheet-shaped medium 9*t* that moves upward. As a result, (the height position h4) of the lower ends of the surrounding members 71, 72, 73, and 74 becomes almost identical to a height position h1 of the suction region VE on the belt lower surface 43*v* of the suction transport belt 43.

Accordingly, the surrounding members 71, 72, 73, and 74 of the surrounding member 70 do not inhibit suction movement of the topmost sheet-shaped medium 9*t* onto the suction unit 41B.

Furthermore, in the suction unit 41B of the feeding apparatus 1, when suction force is generated on the belt lower surface 43*v* of the suction transport belt 43, the left and right surrounding members 71 and 72, the upstream surrounding member 73, and the downstream surrounding member 74 are not deformed toward the suction transport belt 43 due to influence of the suction force and there is almost no risk of contact with the suction transport belt 43.

Furthermore, in the suction unit 41B, there is no possibility that the upstream surrounding member 73 makes contact with and is caught up by an end 43*a* of the suction transport belt 43 on an upstream side in the carrying-out direction D since the relatively large interval d3 is secured from the end 43*a* of the suction transport belt 43 in the carrying-out direction D although there sometimes is influence of the suction force generated on the belt lower surface 43*v* of the suction transport belt 43 and influence of airflow generated by rotation of the suction transport belt 43.

Third Exemplary Embodiment

Figure 12:
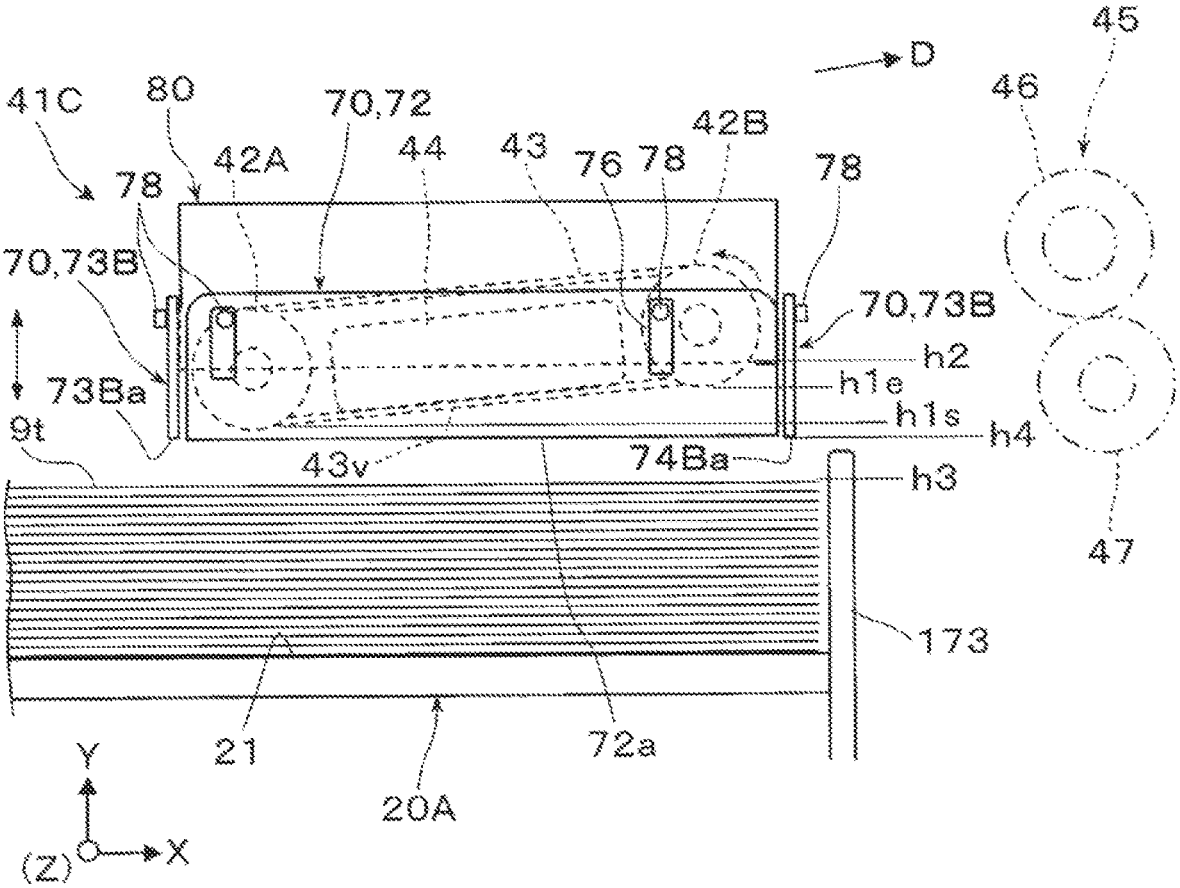
FIG. 12 is a schematic view of a suction unit of a feeding apparatus according to a third exemplary embodiment.

FIG. 12 illustrates a part (a suction unit and others) of a feeding apparatus 1 for feeding a sheet-shaped medium according to the third exemplary embodiment.

The feeding apparatus 1 according to the third exemplary embodiment has a configuration identical to the feeding apparatus 1 according to the second exemplary embodiment except for that the feeding apparatus 1 according to the third exemplary embodiment includes a suction unit 41C. In the following description, identical constituent parts are given reference signs identical to those used in the first and second exemplary embodiments, and description thereof is omitted unless there is necessity.

As illustrated in FIG. 12, the suction unit 41C according to the third exemplary embodiment has a configuration identical to the suction unit 41B according to the second exemplary embodiment except for that a position of a suction transport belt 43 is changed.

Specifically, the suction transport belt 43 in the suction unit 41C is disposed so that a belt lower surface 43*v* thereof becomes an inclined surface whose end on a downstream side in a carrying-out direction D is relatively high. More specifically, a downstream-side roll 42B is disposed at a position shifted upward from an upstream-side roll 42A, and the suction transport belt 43 is suspended across the two rolls 42A and 42B.

Since the belt lower surface 43*v* is an inclined surface, the suction transport belt 43 has, as a height h1 of the belt lower surface 43*v*, a first height his on an upstream side in the carrying-out direction D and a second height h1*e* on a downstream side in the carrying-out direction D, as illustrated in FIG. 12.

Since the transport unit 45 in this feeding apparatus 1 is inclined upward toward a downstream side in the carrying-out direction D in accordance with a change in state where the suction transport belt 43 is disposed, positions of a driving transport roll 46 and a driven transport roll 47 in a transport unit 45 are slightly shifted upward in accordance with the upward inclination in the carrying-out direction D as indicated by the line with alternate long and two short dashes in FIG. 12.

In this suction unit 41C, a left surrounding member 71, a right surrounding member 72, an upstream surrounding member 73, and a downstream surrounding member 74 are provided as a surrounding member 70, as in the case of the suction unit 41B according to the second exemplary embodiment (see FIG. 10B). As for the suction transport belt 43 on a downstream side, the surrounding member is constituted by at least the left and right surrounding members and the downstream surrounding member.

Sheet-Shaped Medium Feeding Operation

Operation of feeding the sheet-shaped medium 9 by the feeding apparatus 1 for feeding a sheet-shaped medium is identical to the feeding operation by the feeding apparatus 1 according to the second exemplary embodiment except for that operation of the suction unit 41C is partially changed as described below.

That is, in the feeding apparatus 1, when sucking operation of the suction box 44 in the suction unit 41C starts, a topmost sheet-shaped medium 9*t* among plural floated sheet-shaped media 9 starts to move upward in the container 17A so that a front end portion thereof in the carrying-out direction D approaches the belt lower surface 43*v* of the suction transport belt 43 by receiving suction force from the suction region VE of the suction transport belt 43 in the suction unit 41C.

At this time, in the suction unit 41C, the left surrounding member 71, the right surrounding member 72, the upstream surrounding member 73, and the downstream surrounding member 74 (strictly, the divided surrounding members 71A, 71B, 72A, 72B, 73A, 73B, 74A, and 74B) that constitute the surrounding member 70 are provided in left and right peripheral positions, a peripheral position on an upstream side in the carrying-out direction D, and a peripheral position on a downstream side in the carrying-out direction D around the suction transport belt 43, and therefore a space S below the belt lower surface 43*v* of the suction transport belt 43 is surrounded on four sides.

Accordingly, a gap between the belt lower surface 43*v* of the suction transport belt 43 and the upper surface of the topmost sheet-shaped medium 9*t* is reduced, the space S below the belt lower surface 43*v* of the suction transport belt 43 is more likely to be in a negative pressure state than a case where the surrounding member 70 is not provided, and suction force on the belt lower surface 43*v* of the suction transport belt 43 is concentrated on an upper surface portion of the topmost sheet-shaped medium 9*t* that faces the suction region VE and thus the suction force improves.

Figure 13A:
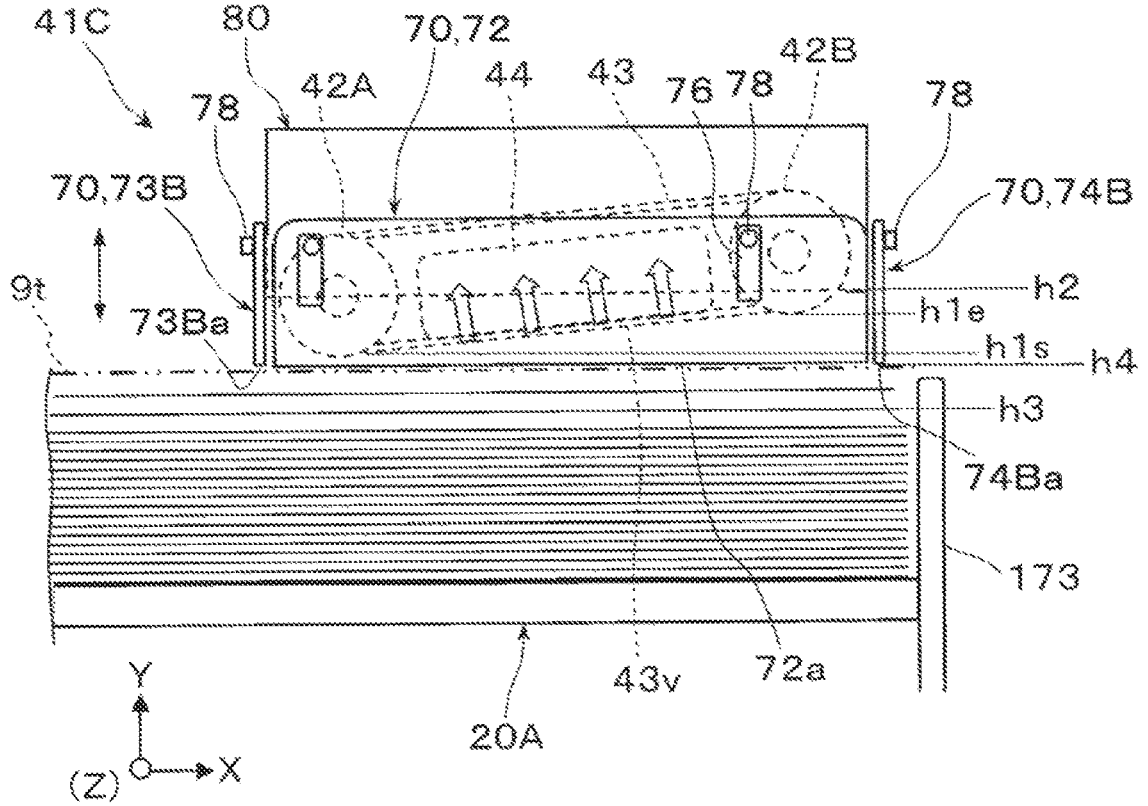
FIG. 13A is a schematic view of one operation state of the suction unit of FIG. 12.

As a result, the front end portion of the topmost sheet-shaped medium 9*t* on a downstream side in the carrying-out direction D makes contact with the lower ends of the left surrounding member 71, the right surrounding member 72, the upstream surrounding member 73, and the downstream surrounding member 74 that constitute the surrounding member 70 during upward movement toward the suction region VE by the suction force from the suction region VE on the belt lower surface 43*v* of the suction transport belt 43, as illustrated in FIG. 13A.

Figure 13B:
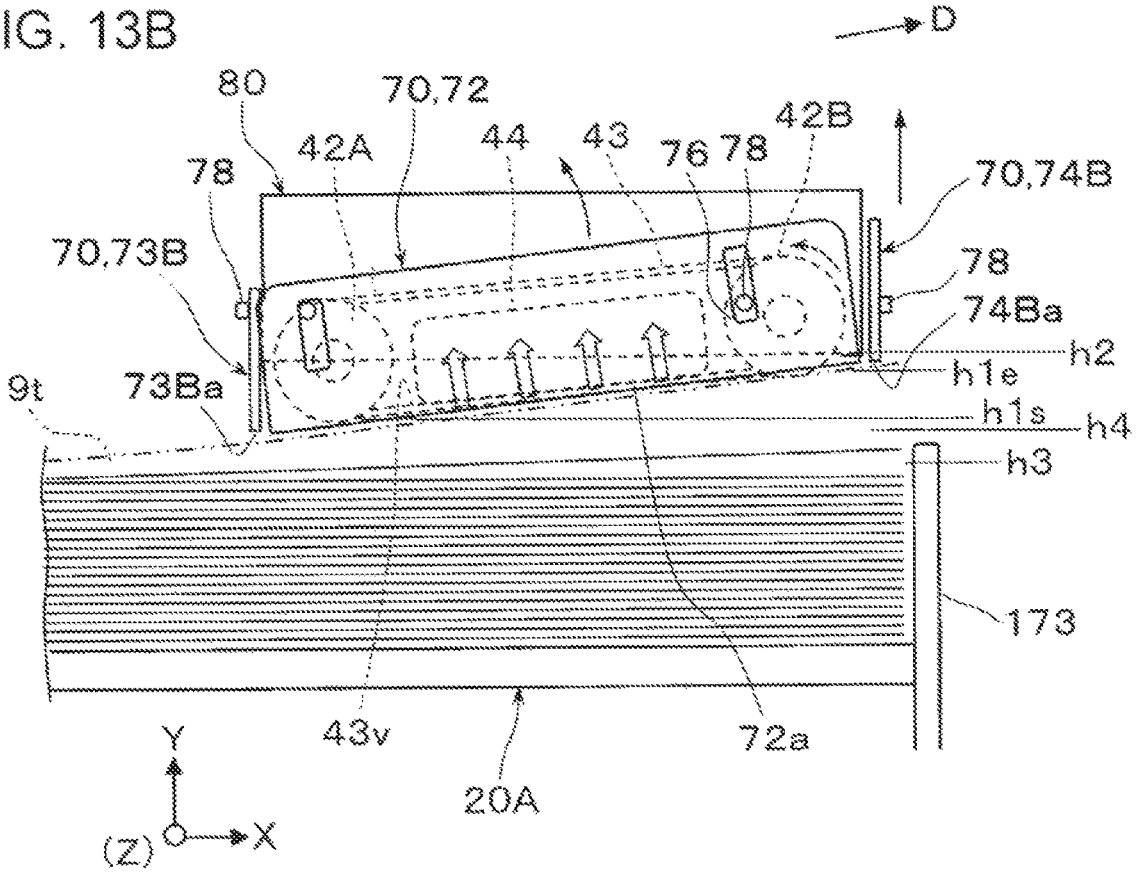
FIG. 13B is a schematic view of a next operation state of the suction unit.

Next, since the belt lower surface 43*v* is an inclined surface, the suction force acts in a direction inclined toward the upstream side in the carrying-out direction D in accordance with the inclined surface, and the front end portion of the topmost sheet-shaped medium 9*t* moves upward together with the left surrounding member 71, the right surrounding member 72, and the downstream surrounding member 74 constituting the surrounding member 70 and is then finally sucked onto the suction region VE of the belt lower surface 43*v*, as illustrated in FIG. 13B.

The left surrounding member 71, the right surrounding member 72, and the downstream surrounding member 74 constituting the surrounding member 70 are pushed upward by the front end portion of the topmost sheet-shaped medium 9*t* that moves upward. As a result, (the height position h4 of) the lower ends of the surrounding members 71, 72, and 73 becomes almost identical to the first height position his and the first height position h1*e* of the suction region VE of the belt lower surface 43*v* of the suction transport belt 43. The left and right surrounding members 71 and 72 move so that ends thereof on a downstream side in the carrying-out direction D move upward and ends thereof in an upstream side in the carrying-out direction D remain at the almost same positions.

Meanwhile, the upstream surrounding member 73 hardly moves upward since the upstream surrounding member 73 is hardly pushed upward by the front end portion of the topmost sheet-shaped medium 9*t* that moves upward.

Accordingly, the surrounding members 71, 72, 73, and 74 of the surrounding member 70 do not inhibit suction movement of the topmost sheet-shaped medium 9*t* by the suction unit 41C.

Furthermore, in the suction unit 41C of the feeding apparatus 1, when suction force is generated on the belt lower surface 43*v* of the suction transport belt 43, the left and right surrounding members 71 and 72, the upstream surrounding member 73, and the downstream surrounding member 74 are not deformed toward the suction transport belt 43 due to influence of the suction force, and there is almost no risk of contact with the suction transport belt 43.

Furthermore, in the suction unit 41C, there is no possibility that the upstream surrounding member 73 makes contact with and is caught up by an end 43*a* of the suction transport belt 43 on an upstream side in the carrying-out direction D since a relatively large interval d3 is secured from the end 43*a* of the suction transport belt 43 in the carrying-out direction D although there sometimes is influence of the suction force generated on the belt lower surface 43*v* of the suction transport belt 43 and influence of airflow generated by rotation of the suction transport belt 43.

Modifications

In the above exemplary embodiments, a case where the left surrounding member 71, the right surrounding member 72, and the upstream surrounding member 73 constituting the surrounding member 70 are provided and a case where the left surrounding member 71, the right surrounding member 72, the upstream surrounding member 73, and the downstream surrounding member 74 constituting the surrounding member 70 are provided have been described, and configuration examples in which each of these surrounding members includes two divided surrounding members arranged side by side have been illustrated. However, it is also possible to employ a configuration in which each surrounding member is not divided and is disposed as a single surrounding member or a configuration in which each surrounding member includes three or more divided surrounding members arranged side by side.

Furthermore, although a configuration example in which the surrounding members 71, 72, 73, and 74 constituting the surrounding member 70 are attached to the support frame 80 in a hanging-down manner so as to be movable up and down, the surrounding members 71, 72, 73, and 74 may be attached to the attachment frame 412 of the suction belt transport mechanism if possible. Furthermore, the support frame 80 may be disposed so as to be fixed to the attachment frame 412, for example, in a case where there is no adverse influence such as operational vibration of the suction belt transport mechanism.

In the suction unit 41C according to the third exemplary embodiment, attachment of the upstream surrounding member 73 as the surrounding member 70 may be omitted, for example, in a case where a distance between an end of the suction transport belt 43 in an upstream side in the carrying-out direction D and the topmost sheet-shaped medium 9*t* during feeding is narrow.

Plural suction transport belts 43 may be disposed side by side in a direction almost orthogonal to the carrying-out direction D. In a case where the plural suction transport belts 43 are applied, the surrounding member 70 need just be disposed at a necessary position around the whole suction transport belts 43. It is also possible to employ a configuration in which the plural suction transport belts 43 are disposed with a gap interposed therebetween and the left and right surrounding members 70 (71 and 72) in the carrying-out direction D are disposed in the gap.

Although the image forming system 100A in which the processing apparatus 120 is the image forming apparatus 120A is illustrated as the using apparatus 100 for using a sheet-shaped medium in the first exemplary embodiment, this is not restrictive. The using apparatus 100 may be any using apparatus that includes the processing apparatus 120 that performs predetermined processing on the sheet-shaped medium 9 fed from the feeding apparatus 1.

Examples of the using apparatus 100 include a printing system in which the processing apparatus 120 is a printer that applies ink onto the sheet-shaped medium 9 or the like, a coating system in which the processing apparatus 120 is a coating device that applies a coating material onto the sheet-shaped medium 9 or the like, and a drying system in which the processing apparatus 120 is a drying device that dries the sheet-shaped medium 9.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A feeding apparatus for feeding a sheet-shaped medium comprising:

a stacking plate on which sheet-shaped media are stacked;

a suction transport belt that is disposed above the stacking plate and causes a topmost one of the stacked sheet-shaped media to be sucked onto a belt lower surface and then rotates to carry out the topmost sheet-shaped medium to a destination; and a surrounding member that is provided in a hanging-down manner at least at left and right positions in a carrying-out direction around the suction transport belt so as to be movable up and down, surrounds a space below the belt lower surface, and is moved upward by contact with the sheet-shaped medium that is sucked upward and not supported by the stacking plate, wherein the suction transport belt is disposed so that a portion, on a downstream side in the carrying-out direction, of the belt lower surface onto which the sheet-shaped medium is sucked protrudes toward a downstream side in the carrying-out direction beyond ends of the stacked sheet-shaped media on a downstream side in the carrying-out direction;

the surrounding member includes at least the left and right surrounding members; and the left and right surrounding members are provided in peripheral positions around a portion of the suction transport belt that faces an upper surface of the stacked sheet-shaped media except for a peripheral position around the protruding portion of the suction transport belt.

2. The feeding apparatus according to claim 1, wherein:

the surrounding member includes left and right surrounding members disposed at the left and right positions and an upstream surrounding member disposed at a position on an upstream side in the carrying-out direction.

3. The feeding apparatus according to claim 2, wherein:

the upstream surrounding member is disposed so that a minimum interval thereof from the suction transport belt is wider than minimum intervals of the left and right surrounding members from the suction transport belt.

4. The feeding apparatus according to claim 3, wherein:

the surrounding member is constituted by a plurality of divided surrounding members arranged side by side in the position where the surrounding member is disposed.

5. The feeding apparatus according to claim 2, wherein:

the surrounding member is constituted by a plurality of divided surrounding members arranged side by side in the position where the surrounding member is disposed.

6. The feeding apparatus according to claim 2, wherein:

lower ends of the surrounding member are lined up at an almost same height position in a state where the sheet-shaped medium is not sucked.

7. The feeding apparatus according to claim 1, wherein:

the surrounding member includes left and right surrounding members disposed at the left and right positions, an upstream surrounding member disposed at a position on an upstream side in the carrying-out direction, and a downstream surrounding member disposed at a position on a downstream side in the carrying-out direction.

8. The feeding apparatus according to claim 7, wherein:

the upstream surrounding member and the downstream surrounding member are disposed so that minimum intervals thereof from the suction transport belt are wider than minimum intervals of the left and right surrounding members from the suction transport belt.

9. The feeding apparatus according to claim 8, wherein:

the surrounding member is constituted by a plurality of divided surrounding members arranged side by side in the position where the surrounding member is disposed.

10. The feeding apparatus according to claim 7, wherein:

the surrounding member is constituted by a plurality of divided surrounding members arranged side by side in the position where the surrounding member is disposed.

11. The feeding apparatus according to claim 1, wherein:

the surrounding member is constituted by a plurality of divided surrounding members arranged side by side in the position where the surrounding member is disposed.

12. The feeding apparatus according to claim 1, wherein:

lower ends of the surrounding member are lined up at an almost same height position in a state where the sheet-shaped medium is not sucked.

13. The feeding apparatus according to claim 1, wherein:

the suction transport belt is disposed so that the belt lower surface faces an inner portion of an upper surface of the stacked sheet-shaped media; and the surrounding member includes at least the left and right surrounding members.

14. The feeding apparatus according to claim 13, wherein:

the suction transport belt is disposed so that the belt lower surface becomes an inclined surface whose end in a downstream side in the carrying-out direction is relatively high; and the surrounding member includes at least the left and right surrounding members and a downstream surrounding member.

15. The feeding apparatus according to claim 1, further comprising a support frame that is disposed at least at left and right positions in the carrying-out direction around the suction transport belt and supports the surrounding member; and the surrounding member is attached to the support frame in a hanging-down manner so as to be movable up and down.

16. The feeding apparatus according to claim 15, wherein:

the support frame is provided independently of the suction transport belt.

17. A using apparatus for using a sheet-shaped medium, comprising:

a feeding apparatus for feeding a sheet-shaped medium that carries out a stacked sheet-shaped medium and feeds the sheet-shaped medium to a destination; and a processing device that performs processing on the sheet-shaped medium fed from the feeding apparatus, wherein the feeding apparatus is the feeding apparatus according to claim 1.

18. A feeding apparatus for feeding a sheet-shaped medium comprising:

a stacking plate on which sheet-shaped media are stacked;

a suction transport belt that is disposed above the stacking plate and causes a topmost one of the stacked sheet-shaped media to be sucked onto a belt lower surface and then rotates to carry out the topmost sheet-shaped medium to a destination; and a surrounding member that is provided in a hanging-down manner at least at left and right positions in a carrying-out direction around the suction transport belt so as to be movable up and down, surrounds a space below the belt lower surface, and is moved upward by contact with the sheet-shaped medium that is sucked upward and not supported by the stacking plate, wherein the suction transport belt is disposed so that the belt lower surface faces an inner portion of an upper surface of the stacked sheet-shaped media;

the surrounding member includes at least the left and right surrounding members;

the suction transport belt is disposed so that the belt lower surface becomes an inclined surface whose end in a downstream side in the carrying-out direction is relatively high;

the surrounding member includes at least the left and right surrounding members and a downstream surrounding member; and the left and right surrounding members are disposed so that at least parts of ends thereof on a downstream side in the carrying-out direction protrude toward a downstream side in the carrying-out direction relative to the downstream surrounding member.

* * * * *